US009971261B2

(12) United States Patent
Takahashi et al.

(10) Patent No.: US 9,971,261 B2
(45) Date of Patent: May 15, 2018

(54) TONER

(71) Applicants: Satoshi Takahashi, Kanagawa (JP); Yoshihiro Moriya, Shizuoka (JP); Ryota Inoue, Shizuoka (JP); Masahiko Ishikawa, Shizuoka (JP); Tatsuki Yamaguchi, Shizuoka (JP); Satoshi Kojima, Shizuoka (JP)

(72) Inventors: Satoshi Takahashi, Kanagawa (JP); Yoshihiro Moriya, Shizuoka (JP); Ryota Inoue, Shizuoka (JP); Masahiko Ishikawa, Shizuoka (JP); Tatsuki Yamaguchi, Shizuoka (JP); Satoshi Kojima, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/423,187

(22) Filed: Feb. 2, 2017

(65) Prior Publication Data

US 2017/0146917 A1 May 25, 2017

Related U.S. Application Data

(63) Continuation of application No. PCT/JP2015/070524, filed on Jul. 17, 2015.

(30) Foreign Application Priority Data

Aug. 6, 2014 (JP) ..... 2014-160403

(51) Int. Cl.

| | |
|---|---|
| ***G03G 9/08*** | (2006.01) |
| ***G03G 9/09*** | (2006.01) |
| ***G03G 9/087*** | (2006.01) |

(52) U.S. Cl.
CPC ..... *G03G 9/0827* (2013.01); *G03G 9/0819* (2013.01); *G03G 9/0821* (2013.01);
(Continued)

(58) Field of Classification Search
CPC ... G03G 9/0819; G03G 9/0821; G03G 9/0827
(Continued)

(56) References Cited

U.S. PATENT DOCUMENTS

| | | | |
|---|---|---|---|
| 7,449,273 | B2 | 11/2008 | Ohki et al. |
| 7,459,255 | B2 | 12/2008 | Tanaka et al. |

(Continued)

FOREIGN PATENT DOCUMENTS

| | | |
|---|---|---|
| JP | 07-152202 | 6/1995 |
| JP | 2005-049858 | 2/2005 |

(Continued)

OTHER PUBLICATIONS

Extended Search Report dated Jun. 21, 2017 in European Patent Application No. 15829885.1.

(Continued)

*Primary Examiner* — Mark A Chapman
(74) *Attorney, Agent, or Firm* — Oblon, McClelland, Maier & Neustadt, L.L.P.

(57) ABSTRACT

An electrostatic-image developing toner including at least a binder resin; a colorant; and a release agent, wherein an average circularity of particles having a particle diameter in a range of 0.79 times or more but less than 1.15 times as large as a most frequent diameter in a number particle size distribution of the toner is within a range of 1.010 times or more but less than 1.020 times as high as an average circularity of particles having a particle diameter of 1.15 times or more as large as the most frequent diameter.

8 Claims, 13 Drawing Sheets

(52) U.S. Cl.
CPC ..... *G03G 9/08711* (2013.01); *G03G 9/08755* (2013.01); *G03G 9/0904* (2013.01); *G03G 9/0918* (2013.01)

(58) Field of Classification Search
USPC ..... 430/110.3, 110.4
See application file for complete search history.

(56) References Cited

U.S. PATENT DOCUMENTS

| | | | |
|---|---|---|---|
| 7,504,188 | B2 | 3/2009 | Yamada et al. |
| 7,531,279 | B2 | 5/2009 | Watanabe et al. |
| 8,263,302 | B2 | 9/2012 | Moriya et al. |
| 8,367,293 | B2 | 2/2013 | Ohtani et al. |
| 8,877,420 | B2 | 11/2014 | Tanaka et al. |
| 2005/0026066 | A1 | 2/2005 | Tanaka et al. |
| 2005/0031980 | A1 | 2/2005 | Inoue et al. |
| 2005/0164112 | A1 | 7/2005 | Ohki et al. |
| 2006/0057488 | A1 | 3/2006 | Inoue et al. |
| 2006/0068312 | A1 | 3/2006 | Yamashita et al. |
| 2006/0099529 | A1 | 5/2006 | Tanaka et al. |
| 2006/0154163 | A1 | 7/2006 | Kidokoro |
| 2006/0160011 | A1 | 7/2006 | Inoue et al. |
| 2006/0210903 | A1 | 9/2006 | Ohki et al. |
| 2007/0059626 | A1 | 3/2007 | Inoue et al. |
| 2007/0141506 | A1 | 6/2007 | Inoue et al. |
| 2007/0218383 | A1 | 9/2007 | Seshita et al. |
| 2008/0070144 | A1 | 3/2008 | Nagatomo et al. |
| 2008/0226998 | A1 | 9/2008 | Ishii et al. |
| 2008/0227002 | A1 | 9/2008 | Moriya et al. |
| 2008/0280224 | A1 | 11/2008 | Inoue et al. |
| 2009/0003885 | A1 | 1/2009 | Sabu et al. |
| 2009/0117480 | A1 | 5/2009 | Yamada et al. |
| 2009/0142094 | A1 | 6/2009 | Sawada et al. |
| 2009/0162770 | A1 | 6/2009 | Sako et al. |
| 2009/0186292 | A1 | 7/2009 | Inoue et al. |
| 2010/0104965 | A1 | 4/2010 | Inoue et al. |
| 2010/0119255 | A1 | 5/2010 | Seshita et al. |
| 2010/0124717 | A1 | 5/2010 | Nakajima et al. |
| 2010/0129748 | A1 | 5/2010 | Inoue et al. |
| 2010/0183967 | A1 | 7/2010 | Sabu et al. |
| 2010/0216068 | A1 | 8/2010 | Kotsugai et al. |
| 2010/0330489 | A1 | 12/2010 | Inoue et al. |
| 2011/0065036 | A1 | 3/2011 | Inoue et al. |
| 2011/0104608 | A1 | 5/2011 | Nakajima et al. |
| 2011/0124838 | A1 | 5/2011 | Kotsugai et al. |
| 2011/0223530 | A1 | 9/2011 | Inoue et al. |
| 2011/0281213 | A1 | 11/2011 | Sakashita et al. |
| 2012/0264049 | A1 | 10/2012 | Masuda et al. |
| 2012/0270147 | A1 | 10/2012 | Katoh et al. |
| 2012/0295188 | A1 | 11/2012 | Nakajima et al. |
| 2013/0045442 | A1 | 2/2013 | Moriya et al. |
| 2013/0065172 | A1 | 3/2013 | Moriya et al. |
| 2013/0069263 | A1 | 3/2013 | Katoh et al. |
| 2013/0095422 | A1 | 4/2013 | Yamamoto et al. |
| 2013/0149642 | A1 | 6/2013 | Sabu et al. |
| 2013/0171550 | A1 | 7/2013 | Amemori et al. |
| 2013/0202996 | A1 | 8/2013 | Yamauchi et al. |
| 2013/0243488 | A1 | 9/2013 | Kojima et al. |
| 2013/0244155 | A1 | 9/2013 | Satoh et al. |
| 2013/0244156 | A1 | 9/2013 | Kojima et al. |
| 2013/0244167 | A1 | 9/2013 | Yamashita et al. |
| 2013/0244168 | A1 | 9/2013 | Yamashita et al. |
| 2013/0273188 | A1 | 10/2013 | Takahashi et al. |
| 2013/0337374 | A1 | 12/2013 | Sugimoto et al. |
| 2014/0038097 | A1 | 2/2014 | Tanaka et al. |
| 2014/0038100 | A1 | 2/2014 | Katoh et al. |
| 2014/0072349 | A1 | 3/2014 | Sakashita et al. |
| 2014/0140731 | A1 | 5/2014 | Hozumi et al. |
| 2014/0141110 | A1 | 5/2014 | Katoh et al. |
| 2014/0220485 | A1 | 8/2014 | Kojima et al. |
| 2014/0234767 | A1 | 8/2014 | Awamura et al. |
| 2014/0242514 | A1 | 8/2014 | Inoue et al. |
| 2014/0272695 | A1 | 9/2014 | Moritani et al. |
| 2014/0342284 | A1 | 11/2014 | Moriya et al. |
| 2015/0104739 | A1 | 4/2015 | Nagatomo et al. |
| 2015/0108671 | A1 | 4/2015 | Norikane et al. |
| 2015/0234303 | A1 | 8/2015 | Moriya et al. |
| 2015/0241804 | A1 | 8/2015 | Takahashi et al. |
| 2015/0253686 | A1 | 9/2015 | Miyakoshi et al. |
| 2015/0261111 | A1 | 9/2015 | Inoue et al. |
| 2015/0362852 | A1 | 12/2015 | Moriya et al. |
| 2016/0266521 | A1* | 9/2016 | Inoue ..... G03G 21/00 |
| 2017/0153574 | A1* | 6/2017 | Kojima ..... G03G 9/087 |

FOREIGN PATENT DOCUMENTS

| | | |
|---|---|---|
| JP | 2008-233406 | 10/2008 |
| JP | 2010-060644 | 3/2010 |
| JP | 2010-060896 | 3/2010 |
| JP | 2010-121008 | 6/2010 |
| JP | 2011-212668 | 10/2011 |
| JP | 2012-185219 | 9/2012 |
| JP | 2012-242711 | 12/2012 |
| JP | 2013-063387 | 4/2013 |
| JP | 2013-064904 | 4/2013 |
| JP | 2014-002244 | 1/2014 |
| JP | 2014-029443 | 2/2014 |
| WO | WO 2004/083964 A1 | 9/2004 |

OTHER PUBLICATIONS

International Search Report dated Sep. 8, 2015 for counterpart International Patent Application No. PCT/JP2015/070524 filed Jul. 17, 2015 ( With English Translation).

Written Opinion dated Sep. 8,2015 in PCT/JP2015/070524, filed Jul. 17, 2015.

Office Action dated Jan. 16, 2018 in Japanese Patent Application No. 2016-540140, filed Sep. 17, 2015.

* cited by examiner

[FIG. 1]
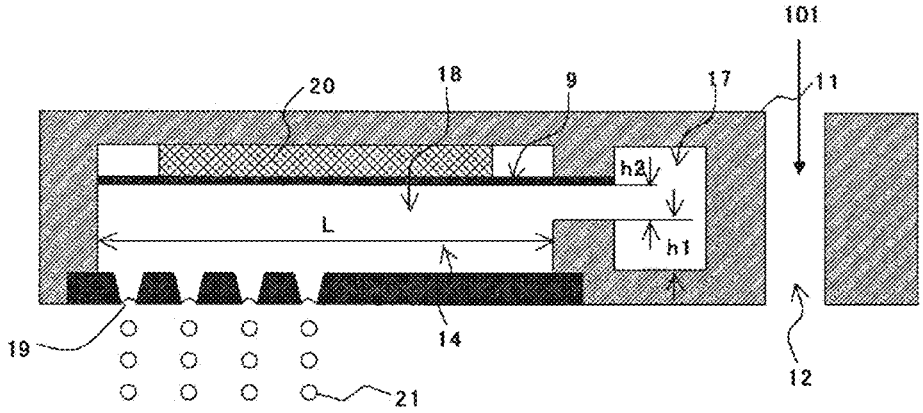
[FIG. 2]
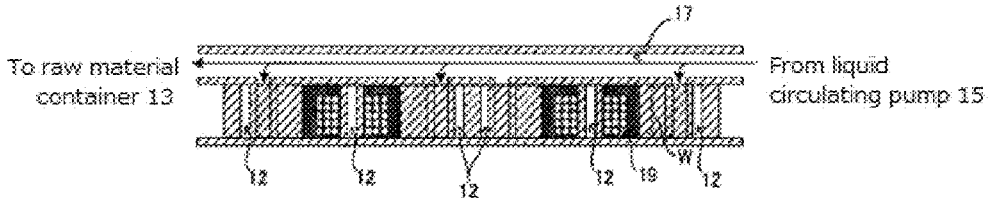
[FIG. 3A]
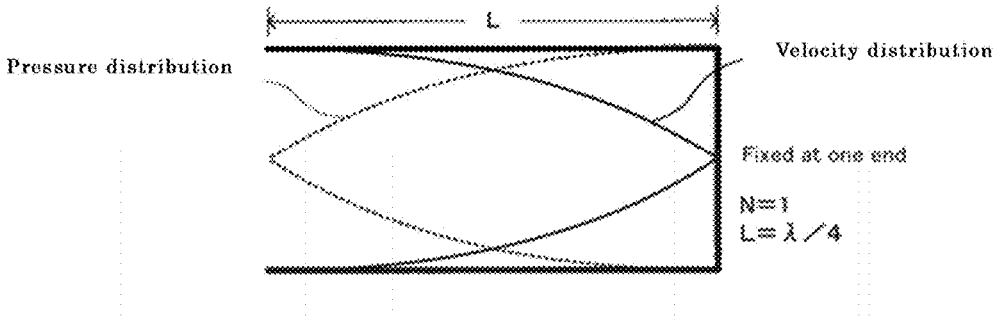

[FIG. 3B]
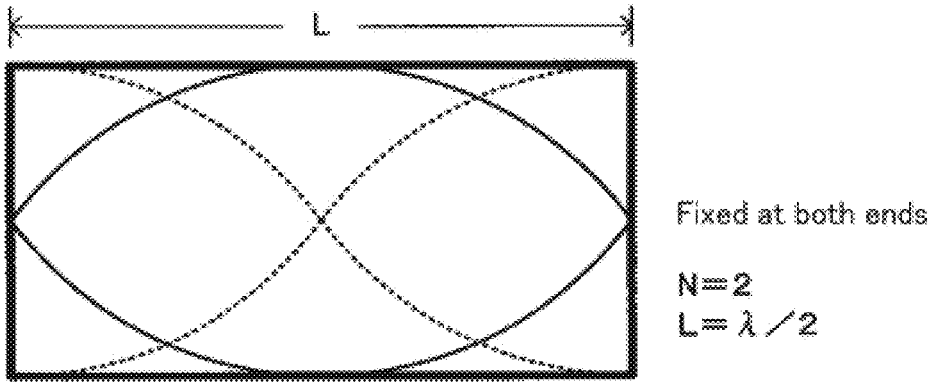
[FIG. 3C]
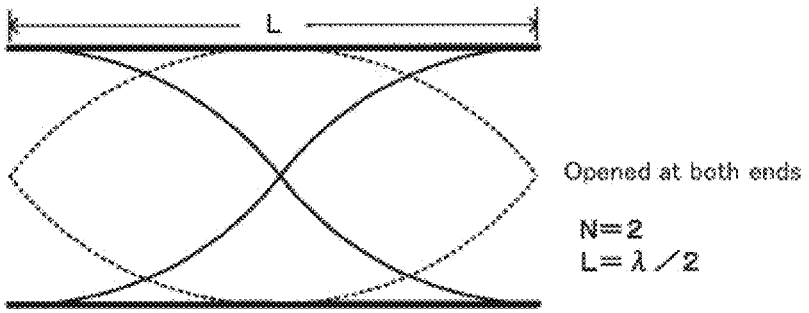
[FIG. 3D]
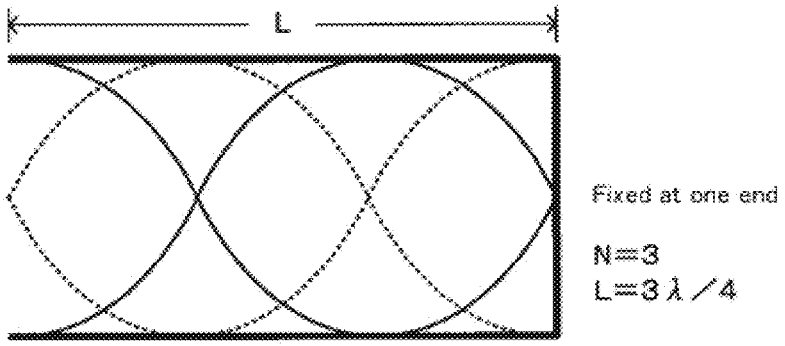

[FIG. 4A]
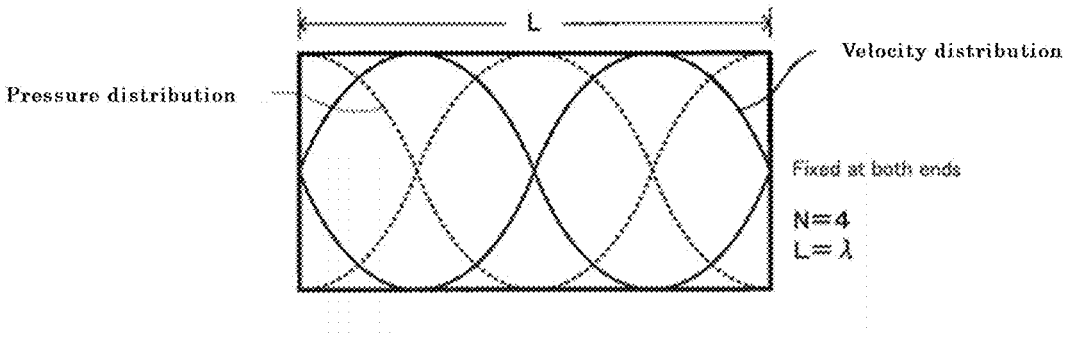
[FIG. 4B]
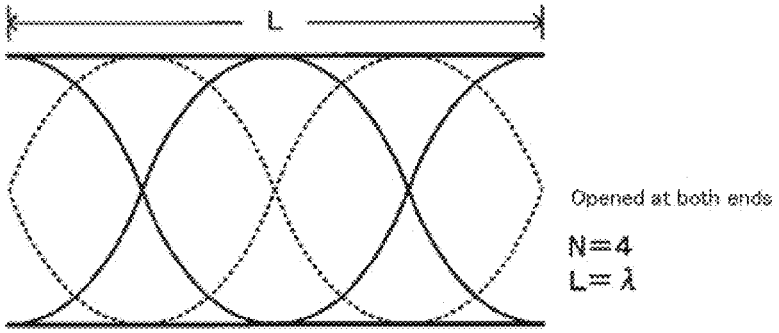
[FIG. 4C]
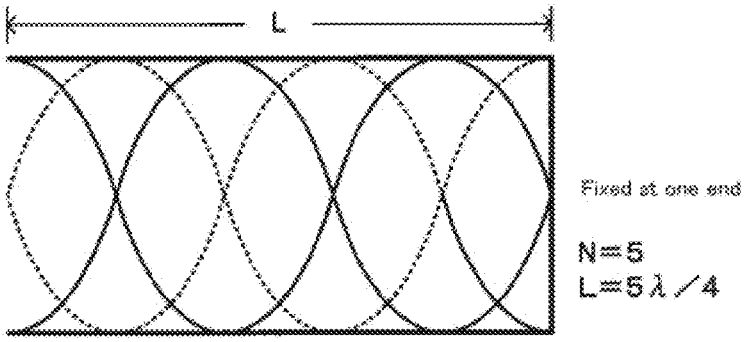

[FIG. 5A]
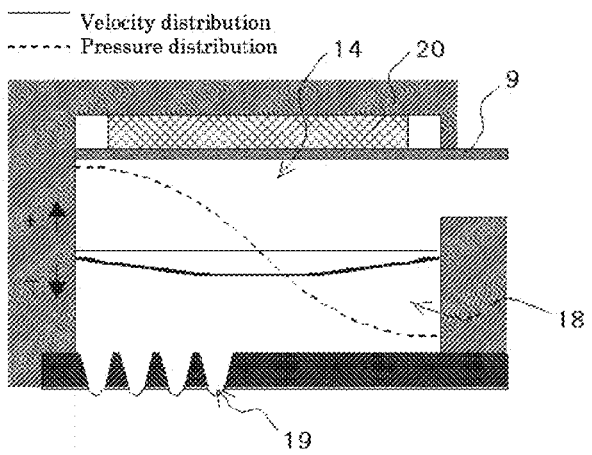
[FIG. 5B]
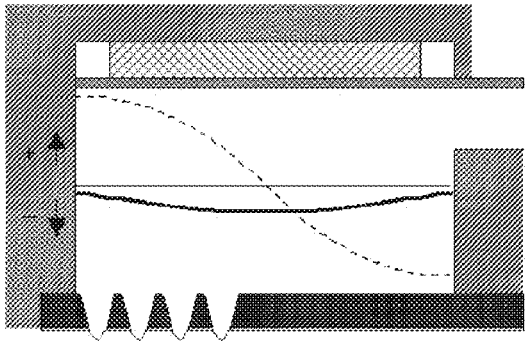
[FIG. 5C]
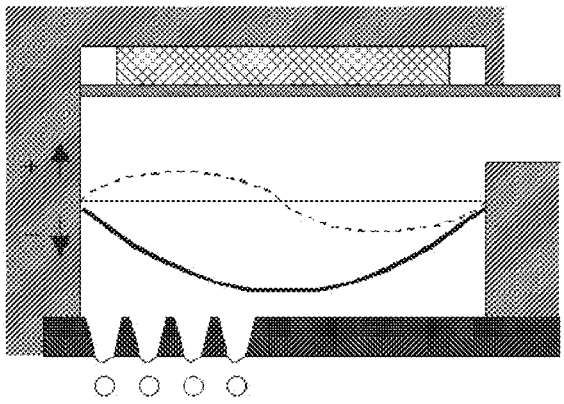

[FIG. 5D]
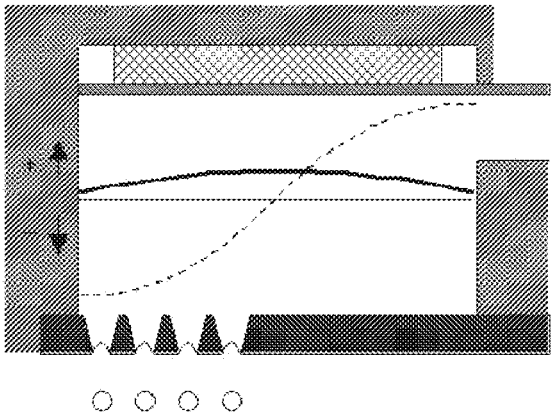
[FIG. 5E]
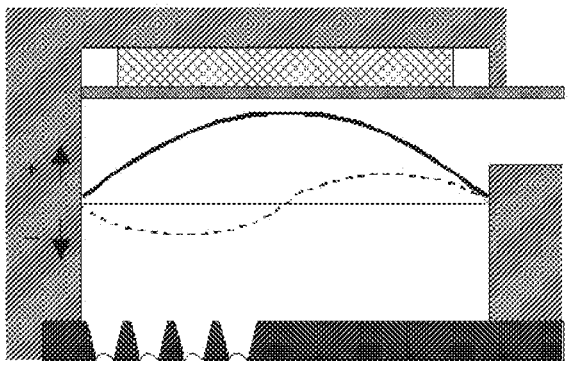

[FIG. 6]
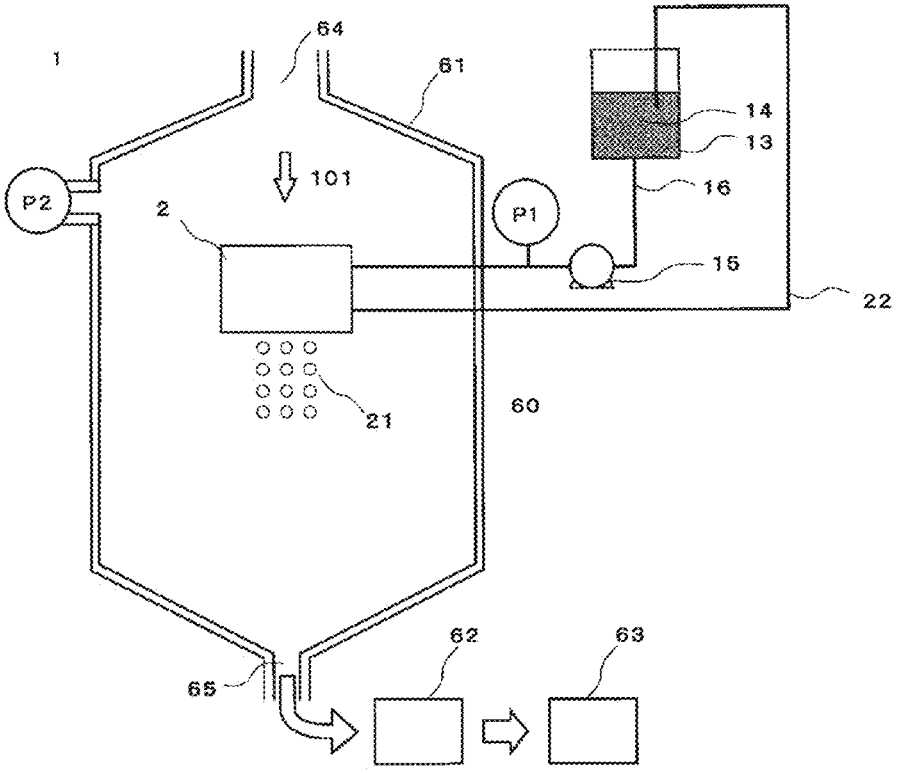
[FIG. 7]
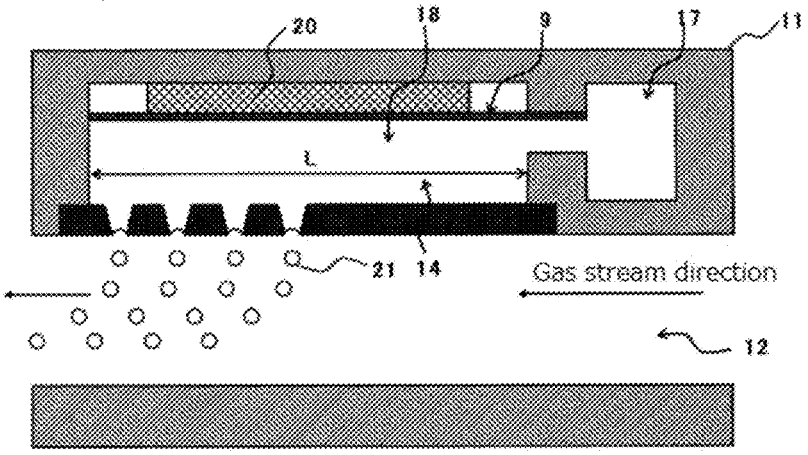

[FIG. 8]
Example 1
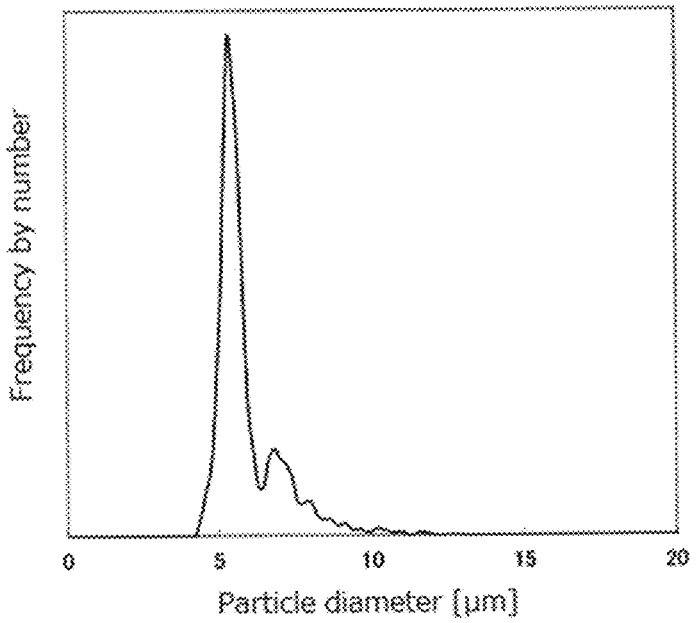

[FIG. 9]
Example 3
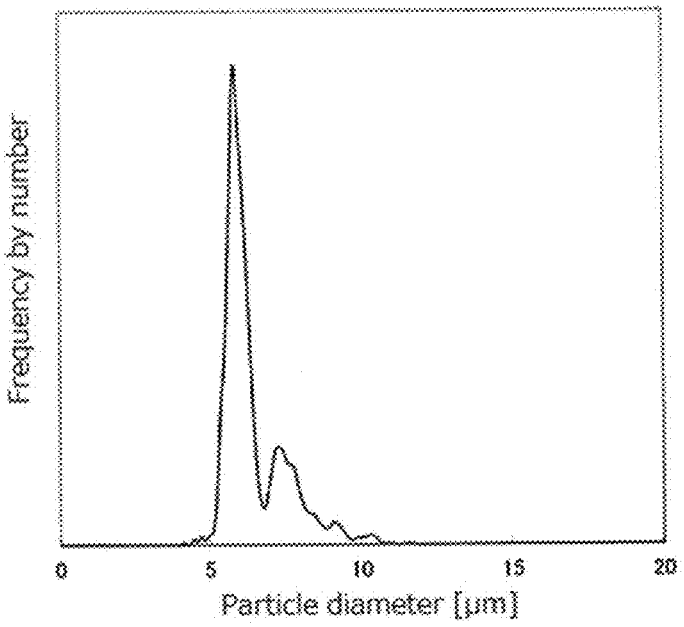

[FIG. 10]
Example 4
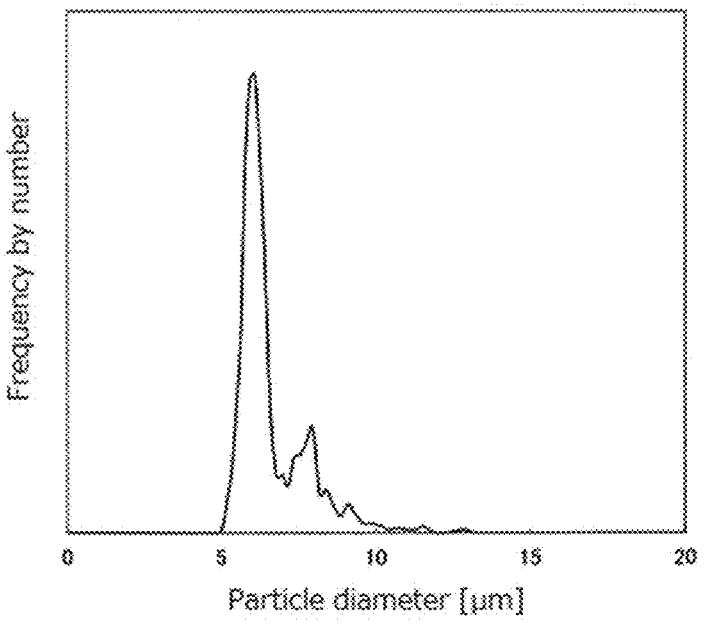

[FIG. 11]
Example 5
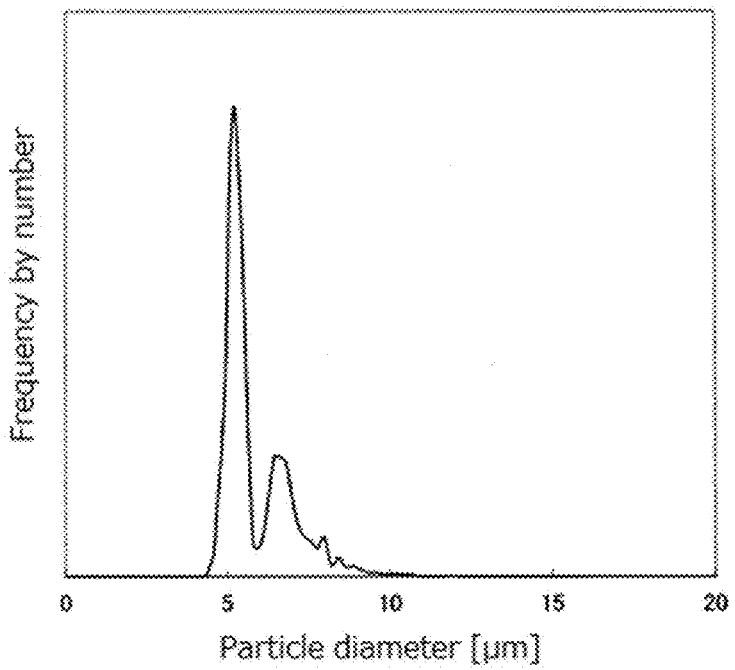

[FIG. 12]
Comparative Example 1
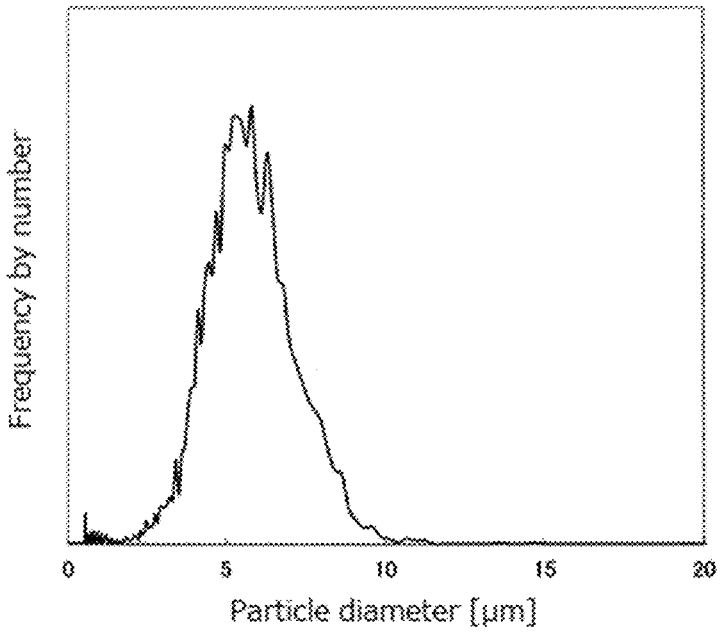

[FIG. 13]
Comparative Example 2
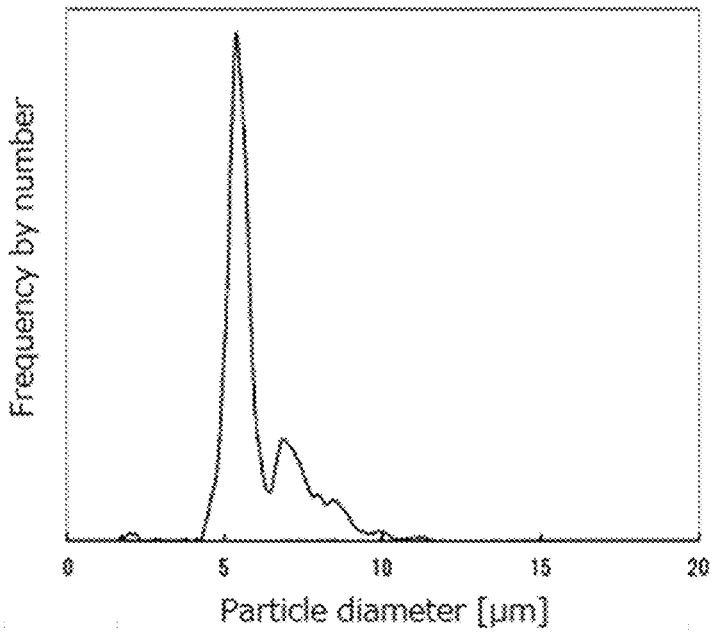

[FIG. 14]
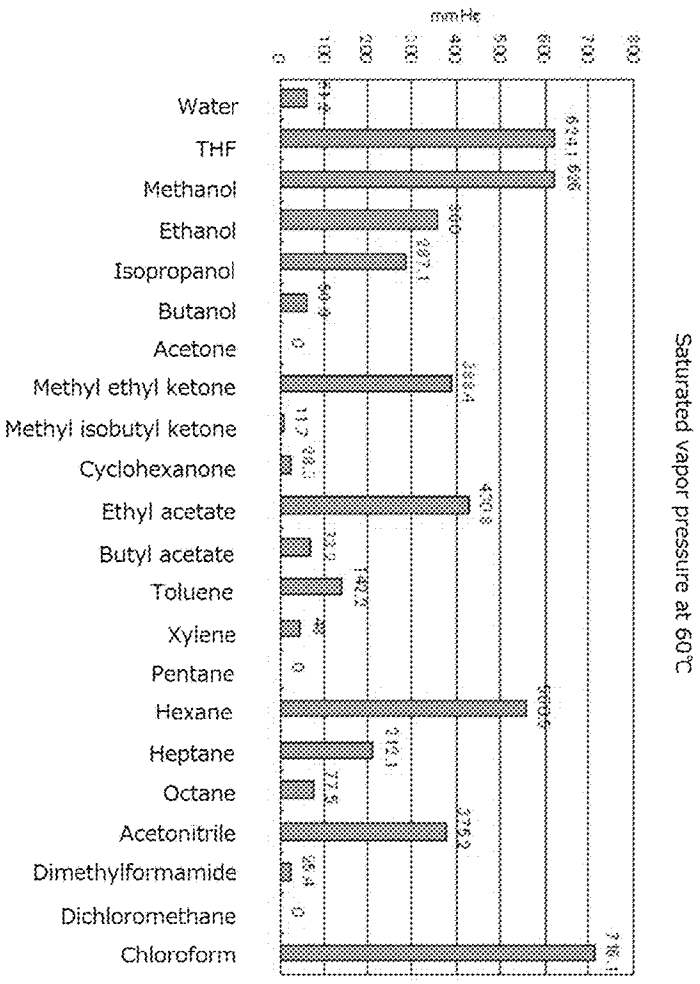

TONER

CROSS-REFERENCE TO RELATED APPLICATIONS

The present application is a continuation application of International Application No. PCT/JP2015/070524, filed Jul. 17, 2015, which claims priority to Japanese Patent Application No. 2014-160403, filed Aug. 6, 2014. The contents of these applications are incorporated herein by reference in their entirety.

BACKGROUND OF THE INVENTION

Field of the Invention

The present invention relates to a toner used for developing an electrostatic image in electrophotography, electrostatic recording, or electrostatic printing.

Description of the Related Art

Toners used in, for example, electrophotography, electrostatic recording, or electrostatic printing are, in a developing step, deposited temporarily on image bearers (e.g., electrostatic latent image bearers) on which electrostatic charge images have been formed. Next, in a transfer step, the thus-deposited toners are transferred from the electrostatic latent image bearers onto transfer media (e.g., transfer paper). Then, the thus-transferred toners are fixed on the media in a fixing step.

At that time, untransferred toners remain as residual toners on latent-image bearing surfaces. Therefore, there is a need to clean the residual toner so as not to disturb the subsequent formation of electrostatic charge images.

Blade cleaning is frequently used in order to clean the residual toners because devices for blade cleaning are simple and good cleanability is capable of being achieved. However, it has been known that the smaller a toner particle diameter is and the closer to spherical a toner shape is, the more difficult it is to clean the residual toners.

Recently, polymerized toners produced by a suspension polymerization method or toners produced by a method called "polymer dissolution suspension method" which is accompanied by volume shrinkage have been put in practical use (see, for example, Japanese Unexamined Patent Application Publication No. 07-152202).

Although the toners produced by the above-described methods are excellent in having a small toner particle diameter, the toners have poor transferability due to a broad particle size distribution. In order to further enhance a transfer efficiency, there is a desire to improve, that is, narrow a particle size distribution of the toners.

The polymerized toners basically include spherical toner particles. Therefore, there has been known a method in which deforming agents (e.g., inorganic fillers and layered inorganic minerals) are allowed to be unevenly distributed on surfaces of toner particles in order to make the toner particles be aspherical (deform the toner particles) in the suspension polymerization method (see, for example, Japanese Unexamined Patent Application Publication Nos. 2005-049858 and 2008-233406).

However, the inorganic fillers and the layered inorganic minerals are difficult to add to particles having small particle diameters in the course of particle formation, so that the particles are likely to be spherical on a smaller particle diameter side. This is because the inorganic fillers and the layered inorganic minerals themselves have particle diameters. As a result, the resultant toner includes particles having a broad shape distribution with different degrees of deformation. In the case of allowing the inorganic fillers and the layered inorganic minerals to be located inside the toner particles, the toner particles are deformed to some extent to improve cleanability. However, leaching out of a release agent or melting out of a binder resin is prevented, resulting in deterioration of low-temperature fixability, hot-offset property, and spreadability.

SUMMARY OF THE INVENTION (1) A toner includes at least a binder resin, a colorant, and a release agent. An average circularity of particles having a particle diameter in a range of 0.79 times or more but less than 1.15 times as large as a most frequent diameter in a number particle size distribution of the toner is within a range of 1.010 times or more but less than 1.020 times as high as an average circularity of particles having a particle diameter of 1.15 times or more as large as the most frequent diameter.

BRIEF DESCRIPTION OF THE DRAWINGS

FIG. 1 is a schematic, cross-sectional view illustrating one exemplary liquid-column resonance liquid-droplet discharging means;

FIG. 2 is a schematic view illustrating one exemplary liquid-column resonance liquid-droplet unit and a bottom view viewed from a discharging surface of FIG. 1;

FIG. 3A is a schematic, explanatory graph illustrating a standing wave of velocity fluctuation and a standing wave of pressure fluctuation when a liquid-column resonance liquid-chamber is fixed at one end and N=1;

FIG. 3B is a schematic, explanatory graph illustrating a standing wave of velocity fluctuation and a standing wave of pressure fluctuation when a liquid-column resonance liquid-chamber is fixed at both ends and N=2;

FIG. 3C is a schematic, explanatory graph illustrating a standing wave of velocity fluctuation and a standing wave of pressure fluctuation when a liquid-column resonance liquid-chamber is free at both ends and N=2;

FIG. 3D is a schematic, explanatory graph illustrating a standing wave of velocity fluctuation and a standing wave of pressure fluctuation when a liquid-column resonance liquid-chamber is fixed at one end and N=3;

FIG. 4A is a schematic, explanatory graph illustrating a standing wave of velocity fluctuation and a standing wave of pressure fluctuation when a liquid-column resonance liquid-chamber is fixed at both ends and N=4;

FIG. 4B is a schematic, explanatory graph illustrating a standing wave of velocity fluctuation and a standing wave of pressure fluctuation when a liquid-column resonance liquid-chamber is free at both ends and N=4;

FIG. 4C is a schematic, explanatory graph illustrating a standing wave of velocity fluctuation and a standing wave of pressure fluctuation when a liquid-column resonance liquid-chamber is fixed at one end and N=5;

FIG. 5A is a schematic view illustrating a liquid-column resonance phenomenon arising in a liquid-column resonance liquid-chamber in a liquid-column resonance liquid-droplet discharging method;

FIG. 5B is a schematic view illustrating a liquid-column resonance phenomenon arising in a liquid-column resonance liquid-chamber in a liquid-column resonance liquid-droplet discharging method;

FIG. 5C is a schematic view illustrating a liquid-column resonance phenomenon arising in a liquid-column resonance liquid-chamber in a liquid-column resonance liquid-droplet discharging method;

FIG. 5D is a schematic view illustrating a liquid-column resonance phenomenon arising in a liquid-column resonance liquid-chamber in a liquid-column resonance liquid-droplet discharging method;

FIG. 5E is a schematic view illustrating a liquid-column resonance phenomenon arising in a liquid-column resonance liquid-chamber in a liquid-column resonance liquid-droplet discharging method;

FIG. 6 is a schematic, cross-sectional view illustrating one exemplary toner producing apparatus used in a method for producing a toner according to the present invention;

FIG. 7 is a schematic view illustrating another exemplary gas stream path;

FIG. 8 is a particle diameter distribution diagram of the toner of Example 1;

FIG. 9 is a particle diameter distribution diagram of the toner of Example 3;

FIG. 10 is a particle diameter distribution diagram of the toner of Example 4;

FIG. 11 is a particle diameter distribution diagram of the toner of Example 5;

FIG. 12 is a particle diameter distribution diagram of the toner of Comparative Example 1;

FIG. 13 is a particle diameter distribution diagram of the toner of Comparative Example 2; and FIG. 14 is a graph representing saturated vapor pressures at 60° C. of organic solvents.

DESCRIPTION OF THE EMBODIMENTS (Toner)

A toner according to the present invention includes at least a binder resin, a colorant, and a release agent. An average circularity of particles having a particle diameter in a range of 0.79 times or more but less than 1.15 times as large as a most frequent diameter in a number particle size distribution of the toner is within a range of 1.010 times or more but less than 1.020 times as high as an average circularity of particles having a particle diameter of 1.15 times or more as large as the most frequent diameter. When the ratio between the average circularities is in a range of 1.010 times or more but less than 1.020 times, both of cleanability and transferability are capable of being achieved at high levels. Additionally, in the case of a color toner, a transfer efficiency is improved to enhance color reproducibility.

The present invention has an object to provide a toner excellent in cleanability, transferability, and color reproducibility.

Means for solving the above problems are as described in the above (1).

According to the present invention, a toner excellent in cleanability, transferability, and color reproducibility is capable of being provided.

The toner according to the present invention preferably has a second peak particle diameter within a range of 1.21 times or more but less than 1.31 times as large as the most frequent diameter in a number particle size distribution.

When the toner does not have the second peak particle diameter, in particular, when a value of (volume average particle diameter/number average particle diameter) is close to 1.00 (monodisperse), the toner is extremely highly close-packed. As a result, the toner is more likely to be deteriorated in initial flowability or cleaning failure is more likely to occur. It is not preferable that the toner have the peak particle diameter of 1.31 times or more as large as the most frequent diameter. This is because a large number of coarse toner particles included in the toner may deteriorate image quality and granularity.

The average circularity of the particles having a particle diameter in a range of 0.79 times or more but less than 1.15 times as large as the most frequent diameter is preferably 0.965 or more but less than 0.985. When the average circularity is 0.985 or more, the particles are spherical. As a result, cleaning failure is more likely to occur. When the average circularity is less than 0.965, the particles are excessively deformed. As a result, carrying failure is more likely to occur in a developing device due to deterioration of flowability.

It is preferable that the average circularity of the particles having a particle diameter in a range of 0.79 times or more but less than 1.15 times as large as the most frequent diameter be 0.975 or more but less than 0.985 and the average circularity of the particles having a particle diameter of 1.15 times or more as large as the most frequent diameter be 0.930 or more but less than 0.960. When the average circularity of the particles having a particle diameter in a range of 0.79 times or more but less than 1.15 times as large as the most frequent diameter is within a relatively high range, i.e., 0.975 or more but less than 0.985 and the average circularity of the particles having a particle diameter of 1.15 times or more as large as the most frequent diameter is within a relatively low range, i.e., 0.930 or more but less than 0.960, the resultant toner has advantages as described below. The toner is capable of having a particle diameter of 1.15 times or more as large as the most frequent diameter even when the average circularity of the particles having a particle diameter in a range of 0.79 times or more but less than 1.15 times as large as the most frequent diameter is high. Simultaneously, cleanability is capable of being ensured due to the presence of the particles having the relatively low average circularity. As a result, both of transferability and cleanability are capable of being more suitably exerted.

A particle size distribution Dv/Dn (volume average particle diameter (μm)/number average particle diameter (μm)) of the particles having a particle diameter in a range of 0.79 times or more but less than 1.15 times as large as the most frequent diameter is preferably $1.00 \leq Dv/Dn < 1.02$. When the particle size distribution $Dv/Dn \geq 1.02$, transferability may be deteriorated.

The most frequent diameter is preferably 3.0 μm or more but 7.0 μm or less from the viewpoint of formation of high-resolution, high-definition, high-quality images.

The particle size distribution Dv/Dn of the toner is preferably $1.05 \leq Dv/Dn < 1.15$ from the viewpoint of maintenance of stable images for a long period of time.

The toner according to the present invention includes at least a binder resin, a colorant, and a release agent; and, if necessary, further includes other components such as a charging control agent.

<Binder Resin>

—Kind of Binder Resin—

The binder resin is not particularly limited and may be appropriately selected from resins known in the art depending on the intended purpose. For example, when the toner is produced by the below-described production method, a toner composition is needed to be dissolved or dispersed in an organic solvent. Therefore, the binder resin dissolvable in the organic solvent is selected. Examples of the binder resin include vinyl-based polymers of vinyl monomers such as styrene monomers, acrylic monomers, and methacrylic monomers; copolymers of two or more kinds of the above-described monomers; polyester resins; polyol resins; phenolic resins; silicone resins; polyurethane resins; polyamide resins; furan resins; epoxy resins; xylene resins; terpene resins; coumarone-indene resins; polycarbonate resins; and petroleum-based resins.

These may be used alone or in combination.

—Molecular Weight Distribution of Binder Resin—

A molecular weight distribution of the binder resin as measured by gel permeation chromatography (GPC) preferably has at least one peak in a molecular weight range of from 3,000 through 50,000 from the viewpoints of fixability and offset resistance of the resultant toner. Moreover, the molecular weight distribution more preferably has at least one peak in a molecular weight range of from 5,000 through 20,000.

Binder resins in which from 60% through 100% of the tetrahydrofuran (THF) soluble matter has a molecular weight of 100,000 or less are preferable.

—Acid Value of Binder Resin—

In the present invention, the binder resin preferably has an acid value of from 0.1 mgKOH/g through 50 mgKOH/g. The acid value of the binder resin is capable of being measured according to JIS K-0070.

<Release Agent>

—Kind of Release Agent—

The release agent is not particularly limited and may be appropriately selected from release agents known in the art depending on the intended purpose. For example, when the toner is produced by the below-described production method, a toner composition is needed to be dissolved or dispersed in an organic solvent. Therefore, the release agent dissolvable in the organic solvent is selected. Examples of the release agent include aliphatic hydrocarbon-based waxes such as low molecular-weight polyethylenes, low molecular-weight polypropylenes, polyolefin waxes, microcrystalline waxes, paraffin waxes, and Sasol waxes; oxides of aliphatic hydrocarbon-based waxes such as polyethylene oxide waxes; or block copolymers of the waxes; vegetable waxes such as candelilla wax, carnauba wax, Japan wax, and jojoba wax; animal waxes such as beeswax, lanolin, and spermaceti wax; mineral waxes such as ozokerite, ceresin, and petrolatum; waxes mainly formed of fatty acid esters, such as montanoic acid ester wax and caster wax; and deoxidized carnauba waxes in which fatty acid esters are partially or fully deoxidized.

—Melting Point of Release Agent—

A melting point of the release agent is not particularly limited and may be appropriately selected depending on the intended purpose. The melting point of the release agent is preferably from 60° C. through 140° C., more preferably from 70° C. through 120° C. from the viewpoint of a balance between fixability and offset resistance. When the melting point is lower than 60° C., the resultant toner may be deteriorated in blocking resistance. When the melting point is higher than 140° C., the resultant toner may be less likely to exert offset resistance.

In the present invention, a peak top temperature of the maximum peak among endothermic peaks of the release agent as measured by differential scanning calorimetry (DSC) is determined as the melting point of the release agent.

A device for measuring the melting point of the release agent or the toner by DSC is preferably a high-precision inner-heat input-compensation differential scanning calorimeter. The melting point is measured according to ASTM D3418-82. A DSC curve used in the present invention is generated by measuring during heating at a heating rate of 10° C./min after taking a previous history by subjecting to one cycle of heating and cooling.

An amount of the release agent to be included is preferably from 0.2 parts by mass through 20 parts by mass, more preferably from 4 parts by mass through 17 parts by mass relative to 100 parts by mass of the binder resin.

<Colorant>

The colorant is not particularly limited and may be appropriately selected from colorants known in the art depending on the intended purpose.

An amount of the colorant to be included is not particularly limited and may be appropriately selected depending on the intended purpose, but is preferably from 1% by mass through 15% by mass, more preferably from 3% by mass through 10% by mass relative to an amount of the toner.

The colorant may be used as a masterbatch which is a composite of the colorant with a resin.

The masterbatch is capable of being obtained by mixing or kneading the colorant and the resin with high shear force being applied. A binder resin to be kneaded together with the masterbatch is not particularly limited and may be appropriately selected from resins known in the art depending on the intended purpose.

These may be used alone or in combination.

An amount of the masterbatch to be used is not particularly limited and may be appropriately selected depending on the intended purpose, but is preferably from 0.1 parts by mass through 20 parts by mass relative to 100 parts by mass of the binder resin.

A dispersing agent may be used during production of the masterbatch in order to enhance pigment dispersibility.

The dispersing agent is not particularly limited and may be appropriately selected from dispersing agents known in the art depending on the intended purpose. The dispersing agent is preferably highly compatible with the binder resin from the viewpoint of pigment dispersibility. Examples of commercially available products of the dispersing agent include "AJISPER PB821" and "AJISPER PB822" (both available from Ajinomoto Fine-Techno Co., Inc.), "DISPERBYK-2001" (available from Byk-Chemie GmbH), "EFKA-4010" (available from EFKA Corporation), and "RSE-801T" (available from Sanyo Chemical Industries, Ltd.).

An amount of the dispersing agent to be added is not particularly limited and may be appropriately selected depending on the intended purpose, but is preferably from 1 part by mass through 200 parts by mass, more preferably from 5 parts by mass through 80 parts by mass relative to 100 parts by mass of the colorant. When the amount is less than 1 part by mass, dispersing ability may be deteriorated. When the amount is more than 200 parts by mass, chargeability may be deteriorated.

<Other Components>

The toner according to the present invention may include other components such as a charging control agent.

<<Charging Control Agent>>

The charging control agent is not particularly limited and may be appropriately selected from charging control agents known in the art depending on the intended purpose. Examples of the charging control agent include nigrosine-based dyes, triphenylmethane-based dyes, chrome-including metal complex dyes, molybdic-acid chelate pigments, rhodamine-based dyes, alkoxy-based amines, quaternary ammonium salts (including fluorine-modified quaternary ammonium salts), alkylamides, phosphorus, phosphorus compounds, tungsten, tungsten compounds, fluorine-based active agents, metal salts of salicylic acid, metal salts of salicylic acid derivatives, and resin-based charging control agents. These may be used alone or in combination.

Other additives such as external additives (e.g., flowability improving agents and cleanability improving agents) may be added to the toner according to the present invention, if necessary.

<<Flowability Improving Agent>>

A flowability improving agent may be added to the toner according to the present invention. The flowability improving agent improves flowability of the toner (makes it likely for the toner to flow) by being added to a surface of the toner.

The flowability improving agent is not particularly limited and may be appropriately selected depending on the intended purpose. Examples of the flowability improving agent include particles of metal oxides [e.g., silica powder (e.g., wet silica and dry silica), titanium oxide powder, and alumina powder], and treated silica, treated titanium oxide, and treated alumina obtained by subjecting the silica powder, the titanium oxide powder, and the alumina powder to surface-treatment with, for example, a silane coupling agent, a titanium coupling agent, or a silicone oil; and fluorine-based resin powder such as vinylidene fluoride powder and polytetrafluoroethylene powder. Among them, silica powder, titanium oxide powder, and alumina powder are preferable, and treated silica obtained by subjecting the silica powder, the titanium oxide powder, or the alumina powder to surface-treatment with, for example, a silane coupling agent or a silicone oil is more preferable.

A particle diameter (average primary particle diameter) of the flowability improving agent is preferably from 0.001 μm through 2 more preferably from 0.002 μm through 0.2 μm.

The silica powder is powder produced through gas-phase oxidation of a silicon halide compound, and is also referred to as dry silica or fumed silica.

Examples of commercially available products of the silica powder produced through gas-phase oxidation of a silicon halide compound include the tradenames AEROSIL-130, AEROSIL-300, AEROSIL-380, AEROSIL-TT600, AEROSIL-MOX170, AEROSIL-MOX80, and AEROSIL-COK84 (available from Nippon Aerosil Co., Ltd.); the tradenames CA-O-SIL-M-5, CA-O-SIL-MS-7, CA-O-SIL-MS-75, CA-O-SIL-HS-5, and CA-O-SIL-EH-5 (available from CABOT Corporation); the tradenames WACKER HDK-N20 V15, WACKER HDK-N20E, WACKER HDK-T30, and WACKER HDK-T40 (available from WACKER-CHEMIE GmbH); the tradename D-CFINESI1ICA (available from Dow Corning Corporation); and the tradename FRANSO1 (available from Fransil Corporation).

Treated silica powder obtained by hydrophobizing the silica powder produced through gas-phase oxidation of a silicon halide compound is more preferable. Treated silica powder which has been treated so as to preferably have hydrophobicity of from 30% through 80% as measured by a methanol titration test is particularly preferable. Silica powder is hydrophobized by being chemically or physically treated with, for example, an organosilicon compound which is reactive with or physically adsorbs to the silica powder. A method in which the silica powder produced through gas-phase oxidation of a silicon halide compound is treated with an organosilicon compound is preferably used.

Examples of the organosilicon compound include hydroxypropyl trimethoxysilane, phenyl trimethoxysilane, n-hexadecyl trimethoxysilane, n-octadecyl trimethoxysilane, vinylmethoxysilane, vinyltriethoxysilane, vinyltriacetoxysilane, dimethylvinylchlorosilane, divinylchlorosilane, γ-methacryloxypropyltrimethoxysilane, examethyldisilane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, trimethylethoxysilane, trimethylmethoxysilane, methyltriethoxysilane, isobutyltrimethoxysilane, dimethyldimethoxysilane, diphenyldiethoxysilane, hexamethyldisiloxane, 1,3-divinyltetramethyldisiloxane, 1,3-diphenyltetramethyldisiloxane; and dimethylpolysiloxane including from 2 through 12 siloxane units per molecule and including from 0 through 1 hydroxyl group bound to Si at each terminal siloxane unit. Further examples include silicone oils such as dimethylsilicone oil. These may be used alone or in combination.

A number average particle diameter of the flowability improving agent is preferably from 5 nm through 100 nm, more preferably from 5 nm through 50 nm.

A specific surface area of the flowability improving agent is preferably 30 $m^2/g$ or more, more preferably from 60 $m^2/g$ through 400 $m^2/g$ in terms of a nitrogen adsorption specific surface area measured according to the BET method.

When the flowability improving agent is in the form of surface-treated powder, the specific surface area is preferably 20 $m^2/g$ or more, more preferably from 40 $m^2/g$ through 300 $m^2/g$.

An amount of the flowability improving agent to be included is preferably from 0.03 parts by mass through 8 parts by mass relative to 100 parts by mass of toner.

<<Cleanability Improving Agent>>

A cleanability improving agent may be used for the purpose of improving removability of a toner remaining on an electrostatic latent image bearer or a primary transfer medium after the toner is transferred onto, for example, a sheet of recording paper. The cleanability improving agent is not particularly limited and may be appropriately selected depending on the intended purpose. Examples of the cleanability improving agent include metal salts of fatty acids such as zinc stearate, calcium stearate, and stearic acid; and polymer particles produced through soap-free emulsion polymerization, such as polymethyl methacrylate particles and polystyrene particles. The polymer particles preferably have a relatively narrow particle size distribution and a weight average particle diameter of from 0.01 μm through 1 μm.

The flowability improving agent and the cleanability improving agent are also referred to as external additives because the flowability improving agent and the cleanability improving agent are used with being deposited or immobilized on a surface of the toner. A method for externally adding such external additives to the toner is not particularly limited and may be appropriately selected depending on the intended purpose. For example, various powder mixers are used. Examples of the powder mixers include V type mixers, rocking mixers, Lodige mixers, Nauta mixers, and Henschel mixers. Examples of powder mixers used when immobilization is also performed include hybridizers, mechanofusions, and Q-mixers.

[Measurement of Particle Diameter and Circularity]

A particle diameter (volume average particle diameter (Dv), number average particle diameter (Dn)) and a circularity of the toner are capable of being measured by means of a flow particle image analyzer.

In the present invention, a flow particle image analyzer FPIA-3000 available from Sysmex Corporation is capable of being used according to analysis conditions described below.

The FPIA-3000 is an apparatus for measuring particle images using an imaging flow cytometry method to analyze particles. A sample dispersion liquid is passed through a flow path (which widens with respect to the flow direction) of a flat, transparent flow cell (about 200 μm in thickness). In order to form an optical path which advances intersecting the thickness of the flow cell, a strobe and a CCD camera are provided so as to be positioned oppositely to each other with respect to the flow cell. A strobe light is emitted at intervals of 1/60 seconds during flowing of the sample dispersion liquid in order to obtain images of particles flowing in the flow cell. As a result, each particle is photographed as a two-dimensional image having a certain region which is parallel to the flow cell. Based upon an area of the two-dimensional image of each particle, a diameter of a circle having the same area as the particle is calculated as a circle equivalent diameter (Dv, Dn).

A circularity is calculated as a ratio of a circumferential length (L) of a circle having the same area as the particle to a circumferential length (l) determined from the two-dimensional image of the particle.

$$\text{Circularity}=(L)/(l)$$

The closer to 1 a value of the circularity is, the more spherical a shape of the particle is.

Specifically, a sample dispersion liquid is produced and measured in the following manner.

—Particle Diameter Measurement Method—

In this measurement, fine dust is removed by filtering through a filter to obtain water that includes only 20 or fewer particles having a circle equivalent diameter within a measured range (for example, 0.60 μm or more but less than 159.21 μm in circle equivalent diameter) in $10^{-3}$ $cm^3$ of the water. Then, a few drops of a nonionic surfactant (preferably, CONTAMINON N, available from Wako Pure Chemical Industries, Ltd.) are added to 10 mL of the water. Then, 5 mg of a measurement sample is further added to the water, and a dispersion treatment is performed for 1 min under conditions of 20 kHz and 50 W/10 $cm^3$ using an ultrasonic disperser UH-50 (available from STM Co., Ltd.). The dispersion treatment is further performed for a total of 5 min. Thus, a sample dispersion liquid in which the measurement sample has a particle concentration of from 4,000 particles/$10^{-3}$ $cm^3$ through 8,000 particles/$10^{-3}$ $cm^3$ (the particles have circle equivalent diameters within the measured range) is obtained. The sample dispersion liquid is used to measure a particle size distribution and circularities of particles having circle equivalent diameters of 0.60 μm or more but less than 159.21 μm.

The toner according to the present invention having the above-described properties is suitably produced by a production method described below. The production method is capable of being used to obtain a toner having a desired particle diameter and a desired shape intended by the present invention, without the use of a deforming agent (e.g., inorganic fillers and layered inorganic minerals) used in, for example, polymerized toners.

(Method for Producing Toner and Toner Producing Apparatus)

A method for producing a toner according to the present invention includes at least a liquid-droplet forming step and a liquid-droplet solidifying step; and, if necessary, further includes other steps.

A toner producing apparatus according to the present invention includes at least a liquid-droplet forming means and a liquid-droplet solidifying means; and, if necessary, further includes other means.

The method for producing a toner according to the present invention is capable of being suitably performed by the toner producing apparatus according to the present invention. The liquid-droplet forming step is capable of being performed by the liquid-droplet forming means. The liquid-droplet solidifying step is capable of being performed by the liquid-droplet solidifying means. The other steps are capable of being performed by the other means.

A liquid used for forming liquid droplets in the present invention is a toner-component including liquid that includes components for forming a toner. The toner-component including liquid only has to be in a liquid state under a condition under which the toner-component including liquid is discharged.

The toner-component including liquid may be a "toner-component solution/dispersion liquid" in which components of the resultant toner are dissolved or dispersed in a solvent or a "toner-component molten liquid" in which the toner components are in a molten state. Note that, a "toner-component including liquid" used for producing a toner is hereinafter referred to as a "toner composition liquid."

The present invention will now be described taking as an example the case of using the "toner-component solution/dispersion liquid" as the toner composition liquid.

<Liquid-Droplet Forming Step and Liquid-Droplet Forming Means>

The liquid-droplet forming step is a step of discharging a toner composition liquid, in which a binder resin, a colorant, and a release agent is dissolved or dispersed, to form liquid droplets.

The liquid-droplet forming means is a means configured to discharge a toner composition liquid, in which a binder resin, a colorant, and a release agent is dissolved or dispersed, to form liquid droplets.

The toner composition liquid is capable of being obtained by dissolving or dispersing in an organic solvent a toner composition that includes at least the binder resin, the colorant, and the release agent, and, if necessary, further includes other components.

The organic solvent is not particularly limited and may be appropriately selected depending on the intended purpose, so long as the organic solvent is a volatile organic solvent in which the toner composition in the toner composition liquid is capable of being dissolved or dispersed, and the binder resin and the release agent included in the toner composition liquid are capable of being dissolved in the organic solvent without phase separation.

The step of discharging a toner composition liquid to form liquid droplets is capable of being performed by discharging liquid droplets using a liquid-droplet discharging means.

The toner according to the present invention is capable of being produced by, for example, discharging and granulating the toner composition in a mixed solvent of solvents having different saturated vapor pressures at a temperature of a conveying gas stream in the liquid-droplet forming step.

When the mixed solvent of solvents having different saturated vapor pressures is not used, there is a decreased difference in solvent drying velocity between at inside and at surface of a particle. As a result, a circularity of coalesced particles (the second peak) is less likely to be different from a circularity of non-coalesced particles (the first peak). Therefore, a ratio of an average circularity of the particles having a particle diameter in a range of 0.79 times or more but less than 1.15 times as large as a most frequent diameter in a number particle size distribution of the toner to an average circularity of the particles having a particle diameter of 1.15 times or more as large as the most frequent diameter is in a range of 1.000 time or more but less than 1.010 times. This indicates that there is little difference between circularities, leading to poor cleanability.

The toner produced by the polymerization method has a broad particle size distribution and includes a large number of excessively deformed particles on a larger particle diameter side. This is because toner particles are formed by aggregating small liquid droplets with each other. Therefore, the ratio of the circularities is large of about 1.05 times. In this case, flowability of powder is deteriorated, leading to carrying failure of a toner in a developing device or poor transferability.

<Organic Solvent>

It is preferable that the organic solvent be a volatile organic solvent in which the toner composition in the toner composition liquid is capable of being dissolved or dispersed, and the binder resin and the release agent included in the toner composition liquid be capable of being dissolved in the organic solvent without phase separation. Moreover, two or more kinds of organic solvents having different saturated vapor pressures at a temperature of a conveying gas stream in the liquid-droplet forming step are preferably used. For example, ethers, ketones, esters, hydrocarbons, and alcohols are preferable, and tetrahydrofuran (THF), acetone, methyl ethyl ketone (MEK), ethyl acetate, butyl acetate, ethyl propionate, toluene, and xylene are particularly preferable. Examples of combinations of solvents having different saturated vapor pressures include combinations of solvents that are not phase-separated from each other such as a combination of ethyl acetate and methyl ethyl ketone, a combination of ethyl acetate and ethyl propionate, a combination of ethyl acetate and butyl acetate, and a combination of butyl acetate and methyl ethyl ketone. Other combinations may also be used, so long as the toner composition components are dissolved without phase separation. Saturated vapor pressures at 60° C. of the above-described organic solvents are presented in FIG. 14. Ethyl acetate, butyl acetate, methyl ethyl ketone, and ethyl propionate have the saturated vapor pressures at 60° C. of 430.8 mmHg, 73.2 mmHg, 388.4 mmHg, and 190.7 mmHg.

The difference in saturated vapor pressure causes a difference in evaporation velocity of the organic solvents in the liquid-droplet forming step and thus a difference in volumetric shrinkage between at surface and at inside of a particle. As a result, particles are deformed. When particles are coalesced with each other in the conveying gas stream in the liquid-droplet forming step prior to drying and solidification, coalesced particles have slower drying velocity than non-coalesced particles. Therefore, the coalesced particles are deformed to a greater extent than the non-coalesced particles.

A preferable mixing ratio of the two or more kinds of organic solvents having different saturated vapor pressures varies depending on combinations of solvents used and is not capable of uniquely defined. However, a solvent having a higher solubility for toner materials is preferably used in a larger amount.

<<Liquid-Droplet Discharging Means>>

The liquid-droplet discharging means is not particularly limited and may be appropriately selected from liquid-droplet discharging means known in the art depending on the intended purpose, so long as the liquid-droplet discharging means is capable of discharging liquid droplets having a narrow particle diameter distribution. Examples of the liquid-droplet discharging means include one-fluid nozzles, two-fluid nozzles, membrane-vibration discharging means, Rayleigh-breakup discharging means, liquid-vibration discharging means, and liquid-column-resonance discharging means.

The membrane-vibration discharging means are described in, for example, Japanese Unexamined Patent Application Publication No. 2008-292976. The Rayleigh-breakup discharging means are described in, for example, Japanese Patent No. 4647506. The liquid-vibration discharging means are described in, for example, Japanese Unexamined Patent Application Publication No. 2010-102195.

In order to make the liquid droplets have a narrower particle diameter distribution and to ensure toner productivity, liquid-droplet forming liquid-column-resonance generated by the liquid-column-resonance discharging means is capable of being utilized. Specifically, vibration is applied by a vibration means to the toner composition liquid in a liquid-column resonance liquid-chamber having a plurality of discharging holes to form a standing wave based on liquid-column resonance. Then, the toner composition liquid is discharged from the plurality of discharging holes formed in regions corresponding to anti-nodes of the standing wave to outside the discharging holes periodically, to thereby form liquid droplets.

<<<Liquid-Column Resonance Liquid-Droplet Discharging Means>>>

The liquid-column resonance liquid-droplet discharging means configured to discharge liquid droplets by utilizing the liquid-column resonance will now be described.

FIG. 1 is a schematic, cross-sectional view illustrating one exemplary liquid-column resonance liquid-droplet discharging means. A liquid-column resonance liquid-droplet discharging means 11 includes a common liquid supplying-path 17 and a liquid-column resonance liquid-chamber 18 configured to store a toner composition liquid. The liquid-column resonance liquid-chamber 18 is in communication with the common liquid supplying-path 17 disposed on one of wall surfaces at both ends in a longitudinal direction. The liquid-column resonance liquid-chamber 18 includes discharging holes 19 and a vibration generating means 20. The discharging holes 19 are disposed on one of wall surfaces that are coupled to the wall surfaces at the both ends and are configured to discharge liquid droplets 21. The vibration generating means 20 is disposed at a wall surface opposite to the wall surface on which the discharging holes 19 are disposed and is configured to generate high frequency vibration in order to form a liquid-column resonance standing wave. Note that, a high-frequency power-source (not illustrated) is coupled to the vibration generating means 20.

A toner composition liquid 14 is supplied into the common liquid supplying-path 17 of a liquid-column resonance liquid-droplet forming unit illustrated in FIG. 2 through a liquid supplying pipe by a liquid circulating pump (not illustrated). Then, the toner composition liquid 14 is supplied into the liquid-column resonance liquid-chamber 18 of the liquid-column resonance liquid-droplet discharging means 11 illustrated in FIG. 1. In the liquid-column resonance liquid-chamber 18 filled with the toner composition liquid 14, a pressure distribution is formed by the action of a liquid-column resonance standing-wave generated by the vibration generating means 20. Then, the liquid droplets 21 are discharged from the discharge holes 19 which are disposed in the regions corresponding to the anti-nodes, where an amplitude and pressure fluctuation are large, of the liquid-column resonance standing-wave. The anti-nodes of the liquid-column resonance standing-wave refer to other regions than nodes of the standing wave. The anti-nodes are preferably regions in which the pressure fluctuation of the standing wave has a large amplitude enough to discharge the liquid, and more preferably regions having a width corresponding to ±¼ of a wavelength from a position of a local maximum amplitude of a pressure standing wave (i.e., a node of a velocity standing wave) in each direction toward positions of a local minimum amplitude.

Even when a plurality of discharge holes are opened, substantially uniform liquid droplets are capable of being formed from the plurality of discharge holes so long as the discharge holes are disposed in the regions corresponding to the anti-nodes of the standing wave. Moreover, the liquid droplets are capable of being discharged efficiently, and the discharge holes are less likely to be clogged. Note that, the toner composition liquid 14 which has flowed through the common liquid supplying-path 17 is returned to a raw-material container via a liquid returning pipe (not illustrated). When the liquid droplets 21 are discharged to decrease an amount of the toner composition liquid 14 in the liquid-column resonance liquid-chamber 18, a larger amount of the toner composition liquid 14 is supplied from the common liquid supplying-path 17 by suction power generated by the action of the liquid-column resonance standing-wave in the liquid-column resonance liquid-chamber 18. As a result, the liquid-column resonance liquid-chamber 18 is refilled with the toner composition liquid 14. When the liquid-column resonance liquid-chamber 18 is refilled with the toner composition liquid 14, an amount of the toner composition liquid 14 flowing through the common liquid supplying-path 17 returns to as before.

The liquid-column resonance liquid-chamber 18 of the liquid-column resonance liquid-droplet discharging means 11 is formed by joining frames with each other. The frames are formed of materials having high stiffness to the extent that a liquid resonance frequency is not influenced at a driving frequency (e.g., metals, ceramics, and silicones). As illustrated in FIG. 1, a length L between wall surfaces at both ends of the liquid-column resonance liquid-chamber 18 in a longitudinal direction is determined based on the principle of the liquid column resonance described below. A width W of the liquid-column resonance liquid-chamber 18 illustrated in FIG. 2 is desirably shorter than ½ of the length L of the liquid-column resonance liquid-chamber 18 so as not to add any frequency unnecessary for the liquid column resonance. A single liquid-droplet forming unit preferably includes a plurality of liquid-column resonance liquid-chambers 18 in order to drastically improve productivity. The number of the liquid-column resonance liquid-chambers is not limited, but a single liquid-droplet forming unit most preferably includes from 100 through 2,000 liquid-column resonance liquid-chambers 18 because both of operability and productivity are capable of being achieved. The common liquid supplying-path 17 is coupled to and in communication with a liquid supplying-path for each liquid-column resonance liquid-chamber. The common liquid supplying-path 17 is in communication with a plurality of liquid-column resonance liquid-chambers 18.

The vibration generating means 20 of the liquid-column resonance liquid-droplet discharging means 11 is not particularly limited, so long as the vibration generating means is capable of being driven at a predetermined frequency. However, the vibration generating means is desirably formed by attaching a piezoelectric material onto an elastic plate 9. The elastic plate constitutes a portion of the wall of the liquid-column resonance liquid-chamber so as not to contact the piezoelectric material with the liquid. The piezoelectric material may be, for example, piezoelectric ceramics such as lead zirconate titanate (PZT), and is often laminated due to typically small displacement amount. Other examples of the piezoelectric material include piezoelectric polymers (e.g., polyvinylidene fluoride (PVDF)) and monocrystals (e.g., crystal, $LiNbO_3$, $LiTaO_3$, and $KNbO_3$). The vibration generating means 20 is desirably disposed so as to be individually controlled for each liquid-column resonance liquid-chamber. It is desirable that the liquid-column resonance liquid-chambers are capable of being individually controlled via the elastic plates by partially cutting a block-shaped vibration member, which is formed of one of the above-described materials, according to geometry of the liquid-column resonance liquid-chambers.

An opening diameter of the discharge hole 19 is desirably in a range of from 1 μm through 40 μm. When the opening diameter is less than 1 μm, very small liquid droplets are formed. As a result, the toner is not obtained in some cases. Moreover, when solid particles (e.g., pigment) are included in the toner, the discharge holes 19 may frequently be clogged to deteriorate productivity. When the opening diameter is more than 40 μm, liquid droplets having a larger diameter are formed. As a result, when the liquid droplets having a larger diameter are dried and solidified to achieve a desired toner particle diameter in a range of from 3.0 μm through 7.0 μm, a toner composition may need to be diluted with an organic solvent to a very thin liquid. Therefore, a lot of drying energy is disadvantageously needed for obtaining a predetermined amount of the toner.

As can be seen from FIG. 2, the discharge holes 19 are preferably disposed in a width direction of the liquid-column resonance liquid-chamber 18 because many discharge holes 19 are capable of being disposed to improve production efficiency. Additionally, it is desirable that a liquid-column resonance frequency be determined appropriately after verifying how the liquid droplets are discharged because the liquid-column resonance frequency varies depending on arrangement of the discharge holes 19.

A cross-sectional shape of the discharge hole 19 is illustrated in, for example, FIG. 1 as a tapered shape with the opening diameter gradually decreasing. However, the cross-sectional shape may be appropriately selected.

—Mechanism of Liquid Droplet Formation—

A mechanism by which liquid droplets are formed by the liquid-droplet forming unit utilizing the liquid column resonance will now be described.

Firstly, the principle of a liquid-column resonance phenomenon that occurs in the liquid-column resonance liquid-chamber 18 of the liquid-column resonance liquid-droplet discharging means 11 illustrated in FIG. 1 will now be described. A wavelength λ at which liquid resonance occurs is determined according to (Expression 1);

$$\lambda = c/f \quad \text{(Expression 1)}$$

where c denotes sound velocity of the toner component liquid in the liquid-column resonance liquid-chamber; and f denotes a driving frequency applied by the vibration generating means 20 to the toner composition liquid 14 serving as a medium.

In the liquid-column resonance liquid-chamber 18 of FIG. 1, a length from a frame end at a fixed end side to an end at a common liquid supplying-path 17 side is represented as L. A height h1 (=about 80 μm) of the frame end at the common liquid supplying-path 17 side is set to about 2 times as high as a height h2 (=about 40 μm) of a communication port. In the case where both ends are considered to be fixed, that is, the end at the common liquid supplying-path 17 side is considered to be equivalent to a closed fixed end, resonance is most efficiently formed when the length L corresponds to an even multiple of ¼ of the wavelength λ. This is capable of being represented by (Expression 2) below:

$$L=(N/4)\lambda \quad \text{(Expression 2)}$$

where N denotes an even number.

The (Expression 2) is also satisfied when the both ends are free, that is, the both ends are completely opened.

Likewise, when one end is equivalent to a free end from which pressure is released, and the other end is closed (fixed end), that is, when one of the ends is fixed or one of the ends is free, resonance is most efficiently formed when the length L corresponds to an odd multiple of ¼ of the wavelength λ. That is, N in the (Expression 2) denotes an odd number.

The most efficient driving frequency f is determined according to (Expression 3) which is derived from the (Expression 1) and the (Expression 2):

$$f=N\times c/(4L) \quad \text{(Expression 3)}$$

where

L denotes a length of the liquid-column resonance liquid-chamber in a longitudinal direction;

c denotes sound velocity of the toner component liquid; and

N denotes an integer.

However, actually, vibration is not amplified unlimitedly because liquid has viscosity which attenuates resonance. Therefore, the resonance has a Q factor, and also occurs at a frequency adjacent to the most efficient driving frequency f calculated according to the (Expression 3), as represented by (Expressions 4) and (Expression 5) described below.

FIGS. 3A to 3D illustrate shapes of standing waves of velocity fluctuation and pressure fluctuation (resonance mode) when N=1, 2, and 3. FIGS. 4A to 4C illustrate shapes of standing waves of velocity fluctuation and pressure fluctuation (resonance mode) when N=4 and 5.

A standing wave is actually a compressional wave (longitudinal wave), but is commonly expressed as illustrated in FIGS. 3A to 3D and 4A to 4C. In FIGS. 3A to 3D and 4A to 4C, a solid line represents a velocity standing wave (V) and a dotted line represents a pressure standing wave (P).

For example, as can be seen from FIG. 3A in which one end is fixed and N=1, an amplitude of a velocity distribution is zero at a closed end and the maximum at an opened end, which is understandable intuitively.

Assuming that a length between both ends of the liquid-column resonance liquid-chamber in a longitudinal direction is L and a wavelength at which liquid column resonance of liquid occurs is λ; the standing wave is most efficiently generated when the integer N is from 1 through 5. A standing wave pattern varies depending on whether each end is opened or closed. Therefore, standing wave patterns in various opening/closing conditions are also described in the drawings. As described below, conditions of the ends are determined depending on states of openings of the discharge holes and states of openings at a supplying side.

Note that, in the acoustics, an opened end refers to an end at which moving velocity of a medium (liquid) reaches the local maximum in a longitudinal direction, but, to the contrary, pressure of the medium (liquid) is zero. Conversely, a closed end is defined as an end at which moving velocity of a medium is zero. The closed end is considered as an acoustically hard wall and reflects a wave. When an end is ideally perfectly closed or opened, resonance standing waves as illustrated in FIGS. 3A to 3D and 4A to 4C are formed by superposition of waves. Standing wave patterns vary depending on the number of the discharge holes and positions at which the discharge holes are opened. Therefore, a resonance frequency appears at a position shifted from a position determined according to the (Expression 3). However, stable discharging conditions are capable of being created by appropriately adjusting the driving frequency.

For example, assuming that sound velocity c of the liquid is 1,200 m/s, a length L of the liquid-column resonance liquid-chamber is 1.85 mm, and a resonance mode in which both ends are completely equivalent to fixed ends due to the presence of walls on the both ends and N=2 is used; the most efficient resonance frequency is calculated as 324 kHz from the (Expression 2).

In another example, assuming that the sound velocity c of the liquid is 1,200 m/s and the length L of the liquid-column resonance liquid-chamber is 1.85 mm, these conditions being the same as above, and a resonance mode in which both ends are equivalent to fixed ends due to the presence of walls at the both ends and N=4 is used; the most efficient resonance frequency is calculated as 648 kHz from the (Expression 2). Thus, a higher-order resonance is capable of being utilized even in a liquid-column resonance liquid-chamber having the same configuration.

In order to increase the frequency, the liquid-column resonance liquid-chamber 18 of the liquid-column resonance liquid-droplet discharging means 11 illustrated in FIG. 1 preferably has both ends which are equivalent to a closed end or are considered as an acoustically soft wall due to influence from openings of the discharge holes 19. However, the both ends may be free. The influence from openings of the discharge holes 19 means decreased acoustic impedance and, in particular, an increased compliance component. Therefore, the configuration in which walls are formed at both ends of the liquid-column resonance liquid-chamber 18 in a longitudinal direction, as illustrated in FIGS. 3B and 4A, is preferable because both of a resonance mode in which both ends are fixed and a resonance mode in which one of ends is free, that is, an end at a discharge hole side is considered to be opened are capable of being used.

The number of openings of the discharge holes 19, positions at which the openings are disposed, and cross-sectional shapes of the discharge holes are also factors which determine the driving frequency. The driving frequency is capable of being appropriately determined based on these factors.

For example, when the number of the discharge holes 19 is increased, the liquid-column resonance liquid-chamber 18 gradually becomes free at an end which has been fixed. As a result, a resonance standing wave which is approximately the same as a standing wave at an opened end is generated and the driving frequency is increased. Further, the end which has been fixed becomes free starting from a position at which an opening of the discharge hole 19 that is the closest to the liquid supplying-path 17 is disposed. As a result, a cross-sectional shape of the discharge hole 19 is changed to a rounded shape or a volume of the discharge hole is varied depending on a thickness of the frame, so that an actual standing wave has a shorter wavelength and a higher frequency than the driving frequency. When a voltage is applied to the vibration generating means at the driving frequency determined as described above, the vibration generating means 20 deforms and the resonance standing wave is generated most efficiently at the driving frequency. The liquid-column resonance standing-wave is also generated at a frequency adjacent to the driving frequency at which the resonance standing wave is generated most efficiently. That is, assuming that a length between both ends of the liquid-column resonance liquid-chamber in a longitudinal direction is L and a distance to a discharge hole 19 that is the closest to an end at the common liquid supplying-path 17 side is Le; the driving frequency f is determined according to (Expression 4) and (Expression 5) described below using both of the lengths L and Le. A driving waveform having, as a main component, the driving frequency f is capable of being used to vibrate the vibration generating means and induce the liquid column resonance to discharge the liquid droplets from the discharge holes.

$$N\times c/(4L)N\times c/(4Le) \quad \text{(Expression 4)}$$

$$N\times c/(4L)\leq f\leq(N+1)\times c/(4Le) \quad \text{(Expression 5)}$$

where

L denotes a length of the liquid-column resonance liquid-chamber in a longitudinal direction;

Le denotes a distance to a discharging hole that is the closest to an end at a liquid supplying path side;

c denotes velocity of an acoustic wave of a toner composition liquid; and

N denotes an integer.

Note that, a ratio of the length L between both ends of the liquid-column resonance liquid-chamber in a longitudinal direction to the distance Le to the discharge hole that is the closest to the end at the liquid supplying side preferably satisfies: Le/L>0.6.

Based on the principle of the liquid-column resonance phenomenon described above, a liquid-column resonance pressure standing-wave is formed in the liquid-column resonance liquid-chamber 18 illustrated in FIG. 1, and the liquid droplet are continuously discharged from the discharge holes 19 disposed in a portion of the liquid-column resonance liquid-chamber 18. Note that, the discharge hole 19 is preferably disposed at a position at which pressure of the standing wave vary to the greatest extent from the viewpoints of high discharging efficiency and driving at a lower voltage.

One liquid-column resonance liquid-chamber 18 may include one discharge hole 19, but preferably includes a plurality of discharge holes from the viewpoint of productivity. Specifically, the number of discharge holes is preferably in a range of from 2 through 100. When the number of discharge holes is more than 100, a voltage to be applied to the vibration generating means 20 is needed to be set at a high level in order to form desired liquid droplets from the more than 100 discharge holes 19. As a result, a piezoelectric material unstably behaves as the vibration generating means 20. When the plurality of discharge holes 19 are opened, a pitch between the discharge ports is preferably 20 μm or longer but equal to or shorter than the length of the liquid-column resonance liquid-chamber. When the pitch between the discharge ports is less than 20 μm, the possibility that liquid droplets, which are discharged from discharge ports adjacent to each other, collide with each other to form a larger droplet is increased. As a result, a toner having a poor particle diameter distribution may be obtained.

Next, in a liquid-column resonance liquid-droplet discharging method, a liquid column resonance phenomenon which occurs in the liquid-column resonance liquid-chamber of a liquid-droplet discharging head of the liquid-droplet forming unit will be described referring to FIGS. 5A to 5E.

Note that, in FIGS. 5A to 5E, a solid line drawn in the liquid-column resonance liquid-chamber represents a velocity distribution plotting velocity at arbitrary measuring positions between an end at the fixed end side and an end at the common liquid supplying path side in the liquid-column resonance liquid-chamber. A direction from the common liquid supplying-path to the liquid-column resonance liquid-chamber is assumed as plus (+), and the opposite direction is assumed as minus (−). A dotted line drawn in the liquid-column resonance liquid-chamber represents a pressure distribution plotting pressure at arbitrary measuring positions between an end at the fixed end side and an end at the common liquid supplying path side in the liquid-column resonance liquid-chamber. A positive pressure relative to atmospheric pressure is assumed as plus (+), and a negative pressure is assumed as minus (−). In the case of the positive pressure, pressure is applied in a downward direction in the drawings. In the case of negative pressure, pressure is applied in an upward direction in the drawings.

In FIGS. 5A to 5E, as described above, the end at the common liquid supplying-path side is opened, and the height of the frame serving as the fixed end (height h1 in FIG. 1) is about 2 times or more as high as the height of an opening at which the common liquid supplying-path 17 is in communication with the liquid-column resonance liquid-chamber 18 (height h2 in FIG. 1). Therefore, the drawings represent temporal changes of a velocity distribution and a pressure distribution under an approximate condition in which the liquid-column resonance liquid-chamber 18 are approximately fixed at both ends.

FIG. 5A illustrates a pressure standing wave (P) and a velocity standing wave (V) in the liquid-column resonance liquid-chamber 18 at a time when liquid droplets are discharged. In FIG. 5B, meniscus pressure is increased again after the liquid droplets are discharged and immediately then the liquid is supplied. As illustrated in FIGS. 5A and 5B, pressure in a flow path, on which the discharge holes 19 are disposed, in the liquid-column resonance liquid-chamber 18 is the local maximum. Then, as illustrated in FIG. 5C, positive pressure adjacent to the discharge holes 19 is decreased and shifted to a negative pressure side. Thus, the liquid droplets 21 are discharged.

Then, as illustrated in FIG. 5D, the pressure adjacent to the discharge holes 19 is the local minimum. From this time point, the liquid-column resonance liquid-chamber 18 starts to be filled with the toner component liquid 14. Then, as illustrated in FIG. 5E, negative pressure adjacent to the discharge holes 19 is decreased and shifted to a positive pressure side. At this time point, the liquid chamber is completely filled with the toner component liquid 14. Then, as illustrated in FIG. 5A, positive pressure in a liquid-droplet discharging region of the liquid-column resonance liquid-chamber 18 is the local maximum again to discharge the liquid droplets 21 from the discharge holes 19. Thus, the liquid-column resonance standing-wave is generated in the liquid-column resonance liquid-chamber by the vibration generating means driven at a high frequency. The discharge holes 19 are disposed in the liquid-droplet discharging region corresponding to the anti-nodes of the liquid-column resonance standing-wave at which pressure varies to the greatest extent. Therefore, the liquid droplets 21 are continuously discharged from the discharge holes 19 in synchronized with an appearance cycle of the anti-nodes.

<Liquid-Droplet Solidifying Step and Liquid-Droplet Solidifying Means>

The liquid-droplet solidifying step is a step of solidifying the liquid droplets to form a toner. Specifically, the toner according to the present invention is capable of being obtained by solidifying and then collecting the liquid droplets of the toner composition liquid discharged into a gas from the liquid-droplet discharging means.

The liquid-droplet solidifying means is a means configured to solidify the liquid droplets to form a toner.

The solidifying is not particularly limited and may be appropriately selected depending on properties of the toner composition liquid, so long as the toner composition liquid is capable of being made into a solid state. For example, when the toner composition liquid is one in which solid raw materials are dissolved or dispersed in a volatile solvent, the toner composition liquid is capable of being solidified by drying the liquid droplets, that is, by volatilizing the solvent in a conveying gas stream after the liquid droplets are jetted. For drying the solvent, the degree of drying is capable of being adjusted by appropriately selecting a temperature, a vapor pressure, a kind of a gas to which the liquid droplets are jetted. The liquid droplets need not be dried completely, so long as collected particles are maintained in a solid state. The collected particles may be additionally dried in a separate step. The liquid droplets may be solidified by subjecting to temperature variation or a chemical reaction.

The collecting is not particularly limited and may be appropriately selected. For example, solidified particles are capable of being collected from the gas by known powder collecting means such as cyclone collectors and back filters.

In the present invention, a toner having a particle size distribution which includes a certain amount of particles coalesced prior to drying is capable of being produced by modifying the method for producing a toner so as to coalesce particles in a liquid-droplet form with each other in the certain amount. The thus-produced toner having the particle size distribution is capable of having good flowability and cleanability as described above. In this case, because coarse particles formed through coalescence of two particles are increased, the resultant toner has the second peak particle diameter within a range of 1.21 times or more but less than 1.31 times as large as the most frequent diameter in a number particle size distribution.

In order to promote coalescence in the certain amount, the above-described modification in production may be appropriately selected. More specifically, the below-described methods may be selected: the number of discharging holes is increased, a pitch between discharging holes is narrowed, or velocity of a conveying gas stream is slowed. An average circularity of toner particles formed of two or more particles is capable of being intentionally decreased by increasing a temperature of a toner collecting section, which temperature serves as a control factor, to a temperature equal to or higher than a glass transition temperature of a non-crystalline resin, preferably to a temperature +1° C. to +5° C. higher than the glass transition temperature of the non-crystalline resin, to coalesce toner particles with each other.

<Embodiment of Toner Producing Apparatus of Present Invention>

A toner producing apparatus used in the method for producing a toner according to the present invention will now be specifically described referring to FIG. 6.

A toner producing apparatus 1 in FIG. 6 includes a liquid-droplet discharging means 2 and a solidifying and collecting unit 60.

The liquid-droplet discharging means 2 is coupled to a raw material container 13 and a liquid circulating pump 15, and is configured to supply the toner component liquid 14 to the liquid-droplet discharging means 2 at any time. The raw material container is configured to store the toner component liquid 14. The liquid circulating pump 15 is configured to supply the toner component liquid 14 stored in the raw material container 13 into the liquid-droplet discharging means 2 through a liquid supplying pipe 16 and to apply pressure to the toner component liquid 14 in the liquid supplying pipe 16 to return the toner component liquid to the raw material container 13 through a liquid returning pipe 22. The liquid supplying pipe 16 includes a liquid pressure gauge P1, and the solidifying and collecting unit 60 includes a chamber pressure gauge P2. Pressure at which the liquid is fed into the liquid-droplet discharging means 2 and pressure inside a drying/collecting unit are managed by the two pressure gauges (P1, P2). When P1>P2, the toner component liquid 14 may disadvantageously leak out from the holes. When P1<P2, a gas may disadvantageously enter the discharging means to stop the liquid droplets from being discharged. Therefore, the relationship P1≈P2 is preferably satisfied.

A conveying gas stream 101 from a conveying-gas-stream inlet-port 64 is formed within a chamber 61. The liquid droplets 21 discharged from the liquid-droplet discharging means 2 are conveyed downward not only by gravity but also by the conveying gas stream 101, passed through a conveying-gas-stream outlet-port 65, collected by a solidified-particle collecting means 62 serving as a toner collecting section, and stored in a toner storing section 62.

—Conveying Gas Stream—

The following may be noted with regard to the conveying gas stream.

When jetted liquid droplets are brought into contact with each other prior to drying, the jetted liquid droplets are aggregated into one particle (hereinafter, this phenomenon may be referred to as coalescence). In order to obtain solidified particles having a uniform particle diameter distribution, it is necessary to keep the jetted liquid droplets apart from each other. However, the liquid droplets are jetted at a certain initial velocity, but gradually slowed down due to air resistance. Therefore, the subsequent liquid droplets catch up with and coalesce with the preceding liquid droplets having been slowed down. This phenomenon occurs constantly. When the thus-coalesced particles are collected, the collected particles have a very poor particle diameter distribution. In order to prevent the liquid droplets from coalescing with each other, the liquid droplets are needed to be solidified and conveyed simultaneously, while preventing, by the action of the conveying gas stream 101, the liquid droplets from slowing down and from contacting with each other. Eventually, the solidified particles are conveyed to the solidified-particle collecting means 62.

For example, as illustrated in FIG. 1, when a portion of the conveying gas stream 101 is orientated in the same direction as a liquid-droplet discharging direction, as a first gas stream, adjacent to the liquid-droplet discharging means, the liquid droplets are capable of being prevented from slowing down immediately after the liquid droplets are discharged. As a result, the liquid droplets are capable of being prevented from coalescing with each other. Alternatively, the gas stream may be orientated in a direction transverse to the liquid-droplet discharging direction, as illustrated in FIG. 7. Alternatively, although not illustrated, the gas stream may be oriented at an angle, the angle being desirably determined so as to discharge the liquid droplets in a direction away from the liquid-droplet discharging means. When a coalescing preventing air-stream is provided in the direction transverse to the liquid-droplet discharging direction as illustrated in FIG. 7, the coalescing preventing air-stream is preferably orientated in a direction in which trajectories of the liquid droplets do not overlap with each other when the liquid droplets are conveyed from the discharging ports by the coalescing preventing air-stream.

After coalescing is prevented with the first gas stream as described above, the solidified particles may be conveyed to the solidified-particle collecting means by a second gas stream.

A velocity of the first gas stream is desirably equal to or higher than a velocity at which the liquid droplets are jetted. When a velocity of the coalescing preventing air-stream is lower than the velocity at which the liquid droplets are jetted, the coalescing preventing air-stream is difficult to exert a function of preventing the liquid droplet particles from contacting with each other, the function being the essential purpose of the coalescing preventing air-stream.

The first gas stream may have an additional property so as to prevent the liquid droplets from coalescing with each other. The first gas stream may not necessarily have the same properties as the second gas stream. The coalescing preventing air-stream may be added with a chemical substance or may be subjected to physical treatment, the chemical substance or the physical treatment having a function to promote solidification of surfaces of the particles.

The conveying gas stream 101 is not limited in terms of a state of gas stream. Examples of the state include laminar flow, swirl flow, and turbulent flow. A kind of a gas constituting the conveying gas stream 101 is not particularly limited. Examples of the kind include air and incombustible gases (e.g., nitrogen). A temperature of the conveying gas stream 101 may be adjusted appropriately, and is desirably constant during production. The chamber 61 may include a means configured to change the state of the conveying gas stream 101. The conveying gas stream 101 may be used not only for preventing the liquid droplets 21 from coalescing with each other but also for preventing the liquid droplets from depositing on the chamber 61.

<Other Steps>

The method for producing a toner according to the present invention may further include a secondary drying step.

When toner particles collected by the solidified-particle collecting means 62 illustrated in FIG. 6 includes a large amount of a residual solvent, secondary drying is performed in order to reduce the residual solvent, if necessary.

The secondary drying is not particularly limited, and may be performed using commonly known drying means such as fluid bed drying and vacuum drying. When an organic solvent remains in the toner, properties of the toner (e.g., heat resistant storability, fixability, and chargeability) are changed over time. Additionally, the organic solvent is volatilized during heat-fixing, which increases the possibility that users and peripheral devices are adversely affected. Therefore, the toner particles need to be sufficiently dried.

(Developer)

A developer according to the present invention includes at least the toner according to the present invention; and, if necessary, further includes other components such as a carrier.

<Carrier>

The carrier is not particularly limited and may be appropriately selected depending on the intended purpose. Examples of the carrier include carriers such as ferrite and magnetite, and resin-coated carriers.

The resin-coated carriers are formed of carrier core particles, and resin coating materials that are resins for covering (coating) surfaces of the carrier core particles.

A volume resistance value of the carriers is not particularly limited and is capable of being set by appropriately adjusting depending on the degree of unevenness on surfaces of the carriers and an amount of a resin with which the carriers are coated, but is preferably from $10^6$ log (Ω·cm) through $10^{10}$ log (Ω·cm).

An average particle diameter of the carriers is not particularly limited and may be appropriately selected depending on the intended purpose, but is preferably from 4 μm through 200 μm.

The present invention relates to the toner according to [1] described below, and also includes embodiments according to [2] to [8].

[1] A toner including:

a binder resin;

a colorant; and a release agent, wherein an average circularity of particles having a particle diameter in a range of 0.79 times or more but less than 1.15 times as large as a most frequent diameter in a number particle size distribution of the toner is within a range of 1.010 times or more but less than 1.020 times as high as an average circularity of particles having a particle diameter of 1.15 times or more as large as the most frequent diameter.

[2] The toner according to [1], wherein the toner has a second peak particle diameter within a range of 1.21 times or more but less than 1.31 times as large as the most frequent diameter in the number particle size distribution of the toner.

[3] The toner according to [1] or [2], wherein the average circularity of the particles having a particle diameter in a range of 0.79 times or more but less than 1.15 times as large as the most frequent diameter is 0.965 or more but less than 0.985.

[4] The toner according to any one of [1] to [3], wherein the average circularity of the particles having a particle diameter in a range of 0.79 times or more but less than 1.15 times as large as the most frequent diameter is 0.975 or more but less than 0.985, and wherein the average circularity of the particles having a particle diameter of 1.15 times or more as large as the most frequent diameter is 0.930 or more but less than 0.960.

[5] The toner according to any one of [1] to [4], wherein a particle size distribution Dv/Dn (volume average particle diameter (nm)/number average particle diameter (μm)) of the particles having a particle diameter in a range of 0.79 times or more but less than 1.15 times as large as the most frequent diameter is $1.00 \leq Dv/Dn < 1.02$.

[6] The toner according to any one of [1] to [5], wherein the most frequent diameter is 3.0 μm or more but 7.0 μm or less.

[7] The toner according to any one of [1] to [6], wherein the toner has the particle size distribution Dv/Dn (volume average particle diameter (μm)/number average particle diameter (μm)) of $1.05 \leq Dv/Dn < 1.15$.

[8] The toner according to any one of [1] to [7], wherein the toner is produced by a method including discharging a toner composition liquid, in which the binder resin, the colorant, and the release agent are dissolved or dispersed, to form liquid droplets and solidifying the liquid droplets to form a toner.

EXAMPLES

The present invention will now be described in more detail referring to Examples and Comparative Examples, but the present invention is not limited to the Examples. Note that, the term "part(s)" denotes part(s) by mass.

Example 1

<Production of Toner 1>

—Preparation of Colorant Dispersion Liquid—

First, as a colorant, a carbon black dispersion liquid was prepared.

Carbon black (REGAL 400, available from Cabot Corporation) (8.0 parts by mass) and a pigment dispersing agent (RSE-801T, available from Sanyo Chemical Industries, Ltd.) (12 parts by mass) were primarily dispersed in ethyl acetate (80 parts by mass) using a mixer equipped with a stirring blade. The resultant primary dispersion liquid was dispersed more finely with a strong shear force by DYNO-MILL to prepare a secondary dispersion liquid in which aggregates were completely removed. The resultant secondary dispersion liquid was further passed through a polytetrafluoroethylene (PTFE) filter having a pore size of 0.45 μm (FLORINATE MEMBRANE FILTER FHLP09050, available from Nihon Millipore Inc.) to disperse the carbon black to a sub-micron level. Thus, the carbon black dispersion liquid was prepared.

—Preparation of Toner Composition Liquid—

A [WAX 1] (2.8 parts by mass) serving as a release agent, a [Polyester resin A] (36.7 parts by mass) and a [Crystalline polyester resin A'] (2.2 parts by mass) serving as a binder resin, and a [FCA-N] (0.7 parts by mass) serving as a charging control agent were mixed together with and dissolved in ethyl acetate (729.2 parts by mass) and methyl ethyl ketone (190 parts by mass) using a mixer equipped with a stirring blade at 70° C. After that, a temperature of the resultant solution was adjusted to 55° C. The colorant dispersion liquid (38.5 parts by mass) was added to the solution. Even after the addition, the pigment was observed to neither be precipitated nor aggregated, and remained evenly dispersed in the mixed solvent of ethyl acetate and methyl ethyl ketone.

The [WAX 1] was a paraffin wax having a melting point of 70.0° C. (HNP11, available from NIPPON SEIRO CO., LTD.).

The [Polyester resin A] was a binder resin formed of terephthalic acid, isophthalic acid, succinic acid, ethylene glycol, and neopentyl glycol and having a weight average molecular weight of 24,000 and a Tg of 60° C.

The [Crystalline polyester resin A'] was a crystalline resin formed of sebacic acid and hexanediol and having a weight average molecular weight of 13,000 and a melting point of 70° C. The weight average molecular weight Mw of the resin was determined by measuring a THF soluble matter of the resin using a gel permeation chromatography (GPC) measuring device GPC-150C (available from Waters Corporation). Columns KF801 to KF807 (available from Shodex Co., Ltd.) were used. As a detector, a RI (Refraction Index) detector was used. Ethyl acetate had a boiling point of 76.8° C.

The [FCA-N] was available from Fujikura Kasei Co., Ltd.

—Production of Toner Base Particles—

A toner was produced using the toner producing apparatus illustrated in FIG. 6.

In this example, a toner composition liquid 14 was supplied into a liquid-droplet discharging means 2. A syringe pump was used as a liquid circulating pump 15. Liquid droplets were discharged using the toner producing apparatus illustrated in FIG. 6. The toner producing apparatus included liquid-droplet discharging heads serving as the liquid-droplet discharging means. The liquid-droplet discharging heads had a rounded cross-sectional shape in which an opening diameter decreases from liquid-contacting surfaces of discharge holes towards discharging ports. The producing apparatus was used under conditions settings described below. A temperature of a container in the production apparatus to which the toner composition liquid was supplied was set to 55° C. and a temperature of a conveying gas stream 101 (temperature of the conveying gas stream in the liquid-droplet forming step) was set to 60° C.

After the liquid droplets were discharged, the liquid droplets were dried and solidified by a liquid-droplet solidifying treatment using dry nitrogen, collected with a cyclon, and then dried with air blowing for 48 hours at 35° C./90% RH, and for 24 hours at 40° C./50% RH. Thus, toner base particles were produced.

Thus, the toner was continuously produced for 24 hours, but the discharging holes were not clogged.

[Conditions of Producing Apparatus]

Longitudinal length L of liquid-column resonance liquid-chamber: 1.85 mm

Number of discharging holes per liquid chamber: 8 holes

Opening diameter of discharging holes: 10.0 nm

Drying temperature (nitrogen): 60° C.

Driving frequency: 310 kHz

Voltage applied to piezoelectric material: 8.0 V

Temperature of toner collecting section: 60° C.

Then, commercially available silica powder a [NAX 50] (primary average particle diameter: 30 nm, available from NIPPON AEROSIL CO., LTD.) (2.8 parts by mass) and a [H20TM] (primary average particle diameter: 20 nm, available from Clariant) (0.9 parts by mass) were mixed with the toner base particles produced as described above (100 parts by mass) using a Henschel mixer. The resultant mixture was passed through a 60 μm·mesh sieve to remove coarse particles or aggregates. Thus, a [Toner 1] was obtained.

Composition of components, evaluation results, and a particle diameter distribution of the toner base particles of the [Toner 1] are presented in Table 1, Table 2, and FIG. 8.

<Production of Developer>

The [Toner 1] (5 parts by mass) was mixed with a carrier described below (95 parts by mass) in a turbula shaker mixer (available from Shinmaru Enterprises Corporation) to obtain a developer.

—Production of Carrier—

Silicone resin (organo straight silicone) 100 parts by mass

Toluene 100 parts by mass

γ-(2-aminoethyl)aminopropyl trimethoxysilane 5 parts by mass

Carbon black 10 parts by mass

The resultant mixture was dispersed with a homomixer for 20 min to prepare a coating layer forming liquid. This coating layer forming liquid was coated onto surfaces of spherical magnetite (particle diameter: 50 μm) (1,000 parts by mass) with a fluid bed coating device. Thus, a magnetic carrier was obtained.

An image forming apparatus containing a [Developer 1] which includes the [Toner 1] was used to evaluate cleanability and transferability of images by evaluation methods described below.

[Evaluation of Cleanability]

The [Developer 1] was charged in a copier (IMAGIO MP 7501, available from Ricoh Company Ltd.) to evaluate for cleanability.

An image having an image area rate of 30% was developed, transferred onto a sheet of transfer paper. Then, operation of the copier was stopped during a cleaning step where untransferred toner remaining on a surface of a photoconductor was cleaned with a cleaning blade. The untransferred toner on the surface of the photoconductor that had undergone the cleaning step was transferred onto a blank sheet of paper with a piece of SCOTCH tape (available from Sumitomo 3M Ltd.) and measured for reflection density by a MACBETH reflection densitometer (Model RD514) at 10 positions. Then, a difference between an average value of the resultant reflection densities and an average value of reflection densities in the case where only a piece of the same tape was attached to a blank sheet of paper was calculated. The difference was evaluated according to evaluation criteria described below.

Note that, the cleaning blade that had undergone the cleaning step 20,000 times was used.

—Evaluation Criteria—

A (Very good): The difference was 0.010 or less.

B (Good): The difference was more than 0.010 but 0.015 or less.

C (Poor): The difference was more than 0.015.

[Evaluation of Transferability]

A copier (IMAGIO MP 7501, available from Ricoh Company Ltd.), which had tuned so as to have a linear velocity of 162 mm/sec and a transfer time of 40 msec, was used as an evaluation device. The [Developer 1] was subjected to a running test in which an A4-sized solid pattern was output at a toner deposition amount of 0.6 mg/cm$^2$ as a test image. A primary transfer efficiency was determined according to (Expression 6) below and a secondary transfer efficiency was determined according to (Expression 7) below for an initial test image and a test image after 100K times outputting. Evaluation criteria were described below.

Primary transfer efficiency (%)=(Amount of toner transferred onto intermediate transfer medium/Amount of toner developed on electrophotographic photoconductor)×100 (Expression 6)

Secondary transfer efficiency (%)=[(Amount of toner transferred onto intermediate transfer medium−Amount of untransferred toner remaining on intermediate transfer medium)/Amount of toner transferred onto intermediate transfer medium]×100 (Expression 7)

—Evaluation Criteria—

Average values of the primary transfer efficiency and the secondary transfer efficiency were calculated and evaluated according to criteria described below.

A . . . 90% or more

B . . . 85% or more but less than 90%

C . . . less than 85%

Example 2

A [Toner 2] was obtained in the same manner as in Example 1, except that the number of the discharging holes per liquid chamber was changed to 10 in the production of toner base particles.

The composition and the evaluation results of the toner base particles of the [Toner 2] are presented in Table 1 and Table 2.

Example 3

A [Toner 3] was obtained in the same manner as in Example 1, except that the opening diameter of the discharging holes was changed to 8.0 μm and a toner composition liquid was prepared as described below.

The composition, the evaluation results, and the particle diameter distribution of the toner base particles of the [Toner 3] are presented in Table 1, Table 2, and FIG. 9.

—Preparation of Toner Composition Liquid—

A [WAX 2] (5.6 parts by mass) and a [WAX 3] (5.6 parts by mass) serving as a release agent, the [Polyester resin A] (68.5 parts by mass) and the [Crystalline polyester resin A'] (4.1 parts by mass) serving as a binder resin, and the [FCA-N] (0.9 parts by mass) serving as a charging control agent were mixed together with and dissolved in ethyl acetate (658.4 parts by mass) and methyl ethyl ketone (180 parts by mass) using a mixer equipped with a stirring blade at 70° C. After that, a temperature of the resultant solution was adjusted to 55° C. The colorant dispersion liquid (76.9 parts by mass) was added to the solution. Even after the addition, the pigment was observed to neither be precipitated nor aggregated, and remained evenly dispersed in the mixed solvent of ethyl acetate and methyl ethyl ketone.

The [WAX 2] was an ester wax having a melting point of 70.0° C. (available from NOF CORPORATION). The [WAX 3] was an ester wax having a melting point of 66.0° C. (available from NOF CORPORATION).

Example 4

A [Toner 4] was obtained in the same manner as in Example 1, except that the opening diameter of the discharging holes was changed 8.0 μm and the toner composition liquid was prepared as described below.

The composition, the evaluation results, and the particle diameter distribution of the toner base particles of the [Toner 4] are presented in Table 1, Table 2, and FIG. 10.

—Preparation of Toner Composition Liquid—

The [WAX 2] (5.6 parts by mass) and the [WAX 3] (11.2 parts by mass) serving as a release agent, the [Polyester resin A] (62.9 parts by mass) and the [Crystalline polyester resin A'] (4.1 parts by mass) serving as a binder resin, and the [FCA-N] (0.9 parts by mass) serving as a charging control agent were mixed together with and dissolved in ethyl acetate (658.4 parts by mass) and methyl ethyl ketone (180 parts by mass) using a mixer equipped with a stirring blade at 70° C. After that, a temperature of the resultant solution was adjusted to 55° C. The colorant dispersion liquid (76.9 parts by mass) was added to the solution. Even after the addition, the pigment was observed to neither be precipitated nor aggregated, and remained evenly dispersed in ethyl acetate.

Example 5

A [Toner 5] was obtained in the same manner as in Example 1, except that the opening diameter of the discharging holes was changed to 8.0 μm and a toner composition liquid was prepared as described below.

The composition, the evaluation results, and the particle diameter distribution of the toner base particles of the [Toner 5] are presented in Table 1, Table 2, and FIG. 11.

—Preparation of Toner Composition Liquid—

The [WAX 2] (11.2 parts by mass) and the [WAX 3] (5.6 parts by mass) serving as a release agent, the [Polyester resin A] (62.9 parts by mass) and the [Crystalline polyester resin A'] (4.1 parts by mass) serving as a binder resin, and the [FCA-N] (0.9 parts by mass) serving as a charging control agent were mixed together with and dissolved in ethyl acetate (658.4 parts by mass) and methyl ethyl ketone (180 parts by mass) using a mixer equipped with a stirring blade at 70° C. After that, a temperature of the resultant solution was adjusted to 55° C. The colorant dispersion liquid (76.9 parts by mass) was added to the solution. Even after the addition, the pigment was observed to neither be precipitated nor aggregated, and remained evenly dispersed in the mixed solvent of ethyl acetate and methyl ethyl ketone.

Example 6

A [Toner 6] was obtained in the same manner as in Example 1, except that the opening diameter of the discharging holes was changed to 8.0 μm and a toner composition liquid was prepared as described below.

The composition and the evaluation results of the toner base particles of the [Toner 6] are presented in Table 1 and Table 2.

—Preparation of Toner Composition Liquid—

The [WAX 2] (11.2 parts by mass) and the [WAX 3] (5.6 parts by mass) serving as a release agent, the [Polyester resin A] (62.9 parts by mass) and the [Crystalline polyester resin A'] (4.1 parts by mass) serving as a binder resin, and the [FCA-N] (0.9 parts by mass) serving as a charging control agent were mixed together with and dissolved in ethyl acetate (658.4 parts by mass) and ethyl propionate (180 parts by mass) using a mixer equipped with a stirring blade at 70° C. After that, a temperature of the resultant solution was adjusted to 55° C. The colorant dispersion liquid (76.9 parts by mass) was added to the solution. Even after the addition, the pigment was observed to neither be precipitated nor aggregated, and remained evenly dispersed in ethyl acetate and ethyl propionate.

Example 7

A [Toner 7] was obtained in the same manner as in Example 1, except that the apparatus that included two kinds of discharging holes having opening diameters of 8.0 μm and 10.0 μm was used and a toner composition liquid was prepared as described below. Percentages of the two kinds of discharging holes having opening diameters of 8.0 μm and 10.0 μm were each 50% relative to a total nozzles.

The composition and the evaluation results of the toner base particles of the [Toner 7] are presented in Table 1 and Table 2.

—Preparation of Toner Composition Liquid—

The [WAX 3] (16.8 parts by mass) serving as a release agent, the [Polyester resin A] (62.9 parts by mass) and the [Crystalline polyester resin A'] (4.1 parts by mass) serving as a binder resin, and the [FCA-N] (0.9 parts by mass) serving as a charging control agent were mixed together with and dissolved in ethyl acetate (658.4 parts by mass) and methyl ethyl ketone (180 parts by mass) using a mixer equipped with a stirring blade at 70° C. After that, a temperature of the resultant solution was adjusted to 55° C. The colorant dispersion liquid (76.9 parts by mass) was added to the solution. Even after the addition, the pigment was observed to neither be precipitated nor aggregated, and remained evenly dispersed in ethyl acetate and methyl ethyl ketone.

Example 8

A [Toner 8] was obtained in the same manner as in Example 1, except that the apparatus that included two kinds of discharging holes having the opening diameters of 9.0 μm and 11.0 μn was used and a toner composition liquid was prepared as described below. Percentages of the two kinds of discharging holes having opening diameters of 9.0 μm and 11.0 μm were each 50% relative to a total nozzles.

The composition and the evaluation results of the toner base particles of the [Toner 8] are presented in Table 1 and Table 2.

—Preparation of Toner Composition Liquid—

The [WAX 3] (16.8 parts by mass) serving as a release agent, the [Polyester resin A] (62.9 parts by mass) and the [Crystalline polyester resin A'] (4.1 parts by mass) serving as a binder resin, and the [FCA-N] (0.9 parts by mass) serving as a charging control agent were mixed together with and dissolved in ethyl acetate (658.4 parts by mass) and methyl ethyl ketone (180 parts by mass) using a mixer equipped with a stirring blade at 70° C. After that, a temperature of the resultant solution was adjusted to 55° C. The colorant dispersion liquid (76.9 parts by mass) was added to the solution. Even after the addition, the pigment was observed to neither be precipitated nor aggregated, and remained evenly dispersed in ethyl acetate and methyl ethyl ketone.

Example 9

A [Toner 9] was obtained in the same manner as in Example 3, except that a colorant dispersion liquid was prepared as described below and a temperature of the toner collecting section of the production apparatus was changed to 65° C.

The composition and the evaluation results of the toner base particles of the [Toner 9] are presented in Table 1 and Table 2.

—Preparation of Colorant Dispersion Liquid—

Firstly, a cyan-pigment dispersion liquid was prepared as a colorant.

A cyan pigment (C. I. PB 15:3, acidic treatment rate: 10%, available from Dainichiseika Color & Chemicals Mfg. Co., Ltd.) (6 parts by mass) and a resin (RSE-801T, available from Sanyo Chemical Industries, Ltd.) (12 parts by mass) were primarily dispersed into ethyl acetate (82 parts by mass) using a mixer with a stirring blade. The resultant primary dispersion liquid was finely dispersed with strong shear force using a bead mill (Model LMZ, available from Ashizawa Finetech Ltd., zirconia bead diameter: 0.3 mm) to prepare a secondary dispersion liquid in which aggregates of 5 μm or more had been completely removed.

The toner of Example 9 was also evaluated for color reproducibility. The evaluation results are presented in Table 2.

[Color Reproducibility (Chroma)]

Image formation was performed on a sheet of POD gloss coated paper at a toner deposition amount of 0.40 mg/cm$^2$ using a tandem-type color image forming apparatus. The thus-formed image was fixed with a fixing member of which temperature was constantly controlled to 190° C. The thus-fixed image was used as an evaluation sample.

The thus-formed solid image was measured for chromaticness indices a* and b* in the L*a*b* color system (CIE: 1976) using a colorimeter (X-RITE 939, available from X-Rite). A value of C* represented by (Expression 8) described below was determined to evaluate a chroma of each of toners.

$$C^*=[(a^*)^2+(b^*)^2]^{1/2} \quad \text{(Expression 8)}$$

—Evaluation Criteria—

A: C* was 65 or more.

B: C* was 60 or more but less than 65.

C: C* was less than 60.

Comparative Example 1

Toner base particles were produced according to an emulsification method described below.

<Preparation of Particle Emulsion>

Water (683 parts by mass), a sodium salt of methacrylic acid ethylene oxide adduct sulfate ester (ELEMINOL RS-30, available from Sanyo Chemical Industries, Ltd.) (11 parts by mass), styrene (83 parts by mass), methacrylic acid (83 parts by mass), butyl acrylate (110 parts by mass), and ammonium persulfate (1 part by mass) were charged into a reaction tank equipped with a stirring bar and a thermometer and stirred at 400 rpm for 15 min to obtain a white emulsion. The resultant white emulsion was heated until a temperature in the system became 75° C. and reacted for 5 hours. The resultant was added with a 1% by mass aqueous ammonium persulfate solution (30 parts by mass) and then aged at 75° C. for 5 hours. Thus, a [Particle dispersion liquid], which was an aqueous dispersion liquid of a vinyl resin (a copolymer of styrene-methacrylic acid-butyl acrylate-sodium salt of methacrylic acid ethylene oxide adduct sulfate ester), was obtained.

The [Particle dispersion liquid] was found to have a volume average molecular weight of 105 nm by measuring with a particle size analyzer (LA-920, available from Horiba, Ltd.). A portion of [Particle dispersion liquid] was dried to isolate the resin matter. The resin matter was found to have a glass transition temperature (Tg) of 59° C. and a weight average molecular weight (Mw) of 150,000.

<Synthesis of Polyester Resin>

A bisphenol A ethylene oxide 2 mol adduct (229 parts by mass), a bisphenol A propylene oxide 3 mol adduct (529 parts by mass), terephthalic acid (208 parts by mass), adipic acid (46 parts by mass), and dibutyl tin oxide (2 parts by mass) were charged into a reaction tank equipped with a cooling tube, a stirrer, and a nitrogen introducing tube, reacted under normal pressure at 230° C. for 8 hours, and then reacted under reduced pressure of from 10 mmHg through 15 mmHg for 5 hours. Then, trimellitic anhydride (30 parts by mass) was added to the reaction tank and reacted under normal pressure at 180° C. for 2 hours to obtain a polyester resin. The polyester resin was found to have a weight average molecular weight (Mw) of 6,700, a glass transition temperature (Tg) of 43° C., and an acid value of 20 mgKOH/g.

<Preparation of Aqueous Phase>

Water (990 parts by mass), the [Particle dispersion liquid] (183 parts by mass), a 48.5% by mass aqueous solution of sodium dodecyl diphenyl ether disulfonate ("ELEMINOL MON-7," available from Sanyo Chemical Industries, Ltd.) (37 parts by mass), and ethyl acetate (90 parts by mass) were mixed and stirred to obtain a milky white liquid (i.e., aqueous phase).

<Synthesis of Low Molecular-Weight Polyester>

A bisphenol A ethylene oxide 2 mol adduct (682 parts by mass), a bisphenol A propylene oxide 2 mol adduct (81 parts by mass), terephthalic acid (283 parts by mass), trimellitic anhydride (22 parts by mass), and dibutyl tin oxide (2 parts by mass) were charged into a reaction tank equipped with a cooling tube, a stirrer, and a nitrogen introducing tube and reacted under normal pressure at 230° C. for 5 hours to synthesize a low molecular-weight polyester.

The resultant low molecular-weight polyester was found to have a number average molecular weight (Mn) of 2,100, a weight average molecular weight (Mw) of 9,500, a glass transition temperature (Tg) of 55° C., an acid value of 0.5 mgKOH/g, and a hydroxyl value of 51 mgKOH/g.

<Synthesis of Modified Polyester including Reactive Substituent>

The low molecular-weight polyester (410 parts by mass), isophorone diisocyanate (89 parts by mass), and ethyl acetate (500 parts by mass) were charged into a reaction tank equipped with a cooling tube, a stirrer, and a nitrogen introducing tube and then reacted at 100° C. for 5 hours, to synthesize a modified polyester including a reactive substituent.

The resultant modified polyester including a reactive substituent was found to have a free isocyanate content of 1.53% by mass.

<Preparation of Cyan Masterbatch>

Water (1,200 parts by mass), a colorant (C. I. PB 15:3, available from Dainichiseika Color & Chemicals Mfg. Co., Ltd.) (270 parts by mass), a pigment derivative (SOLSPERSE 5000, available from The Lubrizol Corporation) (8 parts by mass), and the polyester resin (1,200 parts by mass) were mixed together with a Henschel mixer (available from Nippon Coke & Engineering Co., Ltd.). The resultant mixture was kneaded with a two-roll mill at 150° C. for 30 min, rolled and cooled, and then pulverized with a pulverizer (available from Hosokawa Micron Corp.) to prepare a masterbatch.

<Preparation of Organic Solvent Phase>

The polyester resin (378 parts by mass), a carnauba wax (110 parts by mass), and ethyl acetate (947 parts by mass) were charged into a reaction tank equipped with a stirring bar and a thermometer, heated to 80° C. with stirring, held at 80° C. for 30 hours, cooled to 30° C. for 1 hour. Thus, a raw material solution was obtained.

The resultant raw material solution (1,324 parts by mass) was transferred to an another reaction tank and dispersed with a bead mill ("ULTRA VISCO MILL", available from Aimex Co., Ltd.) at a liquid feeding velocity of 1 kg/hr, at a disk peripheral velocity of 6 m/sec, and with 0.5 mm zirconia beads packed to 80% by volume for 9 hours. Thus, the carnauba wax was dispersed.

Then, a 65% by mass solution of the low molecular-weight polyester in ethyl acetate (1,324 parts by mass), and then the masterbatch (500 parts by mass) and ethyl acetate (500 parts by mass) were added to the dispersion liquid and mixed together for 1 hour. Then, the resultant mixed liquid was kept at 25° C. and dispersed with Ebaramilder (a combination of G, M, and S from an inlet side) for 4 passes at a flow rate of 1 kg/min to prepare an organic solvent phase (pigment/wax dispersion liquid).

The resultant organic solvent phase was found to have a solid content concentration (at 130° C., 30 min) of 50% by mass.

<Emulsification and Dispersion>

The organic solvent phase (749 parts by mass), the modified polyester including a reactive substituent (115 parts by mass), and isophoronediamine (available from Wako Pure Chemical Industries, Ltd.) (2.9 parts by mass) were charged into a reaction tank and mixed with a homomixer (TK HOMOMIXER MKII, available from PRIMIX Corporation) at 5,000 rpm for 1 min. Then, the aqueous phase (1,200 parts by mass) was added to the reaction tank and mixed with the homomixer at 9,000 rpm for 3 min. Then, the resultant was stirred with a stirrer for 20 min to prepare an emulsified slurry.

Next, the emulsified slurry was charged into a reaction tank equipped with a stirrer and a thermometer and desolvated at 25° C. After the organic solvent was removed, the residue was aged at 45° C. for 15 hours to obtain a dispersed slurry.

<Washing Step>

The dispersed slurry (100 parts by mass) was filtered under reduced pressure. Then, ion-exchanged water (100 parts by mass) was added to the resultant filter cake, mixed together with a homomixer (at the number of revolutions of 8,000 rpm for 10 min), and then filtered. Ion-exchanged water (100 parts by mass) was added to the resultant filter cake, mixed together with a homomixer (at the number of revolutions of 8,000 rpm for 10 min), and then filtered under reduced pressure. A 10% by mass aqueous sodium hydroxide solution (100 parts by mass) was added to the resultant filter cake, mixed together with a homomixer (at the number of revolutions of 8,000 rpm for 10 min), and then filtered. A 10% by mass hydrochloric acid (100 parts by mass) was added to the resultant filter cake, mixed together with a homomixer (at the number of revolutions of 8,000 rpm for 10 min), and then filtered. Ion-exchanged water (300 parts by mass) was added to the resultant filter cake, mixed together with a homomixer (at the number of revolutions of 8,000 rpm for 10 min), and then filtered. The above-described procedures were repeated twice to obtain a final filter cake. The resultant final filter cake was dried with an air circulating dryer at 45° C. for 48 hours and sieved through a 75 μm-mesh sieve to obtain a [Comparative toner 1] (emulsified toner base particles).

The resultant [Comparative toner 1] was measured and evaluated in the same manner as in Example 1. The results were presented in Table 2 and the particle diameter distribution was presented in FIG. 12.

Comparative Example 2

A [Comparative toner 2] was obtained in the same manner as in Example 1, except that a toner composition liquid was prepared as described below.

Composition and evaluation results of the toner base particles of the [Comparative Example 2] are presented in Table 1 and Table 2.

—Preparation of Toner Composition Liquid—

The [WAX 2] (5.6 parts by mass) and the [WAX 3] (5.6 parts by mass) serving as a release agent, the [Polyester resin A] (68.5 parts by mass) and the [Crystalline polyester resin A'] (4.1 parts by mass) serving as a binder resin, and the [FCA-N] (0.9 parts by mass) serving as a charging control agent were mixed together with and dissolved in ethyl acetate (838.4 parts by mass) using a mixer equipped with a stirring blade at 70° C. After that, a temperature of the resultant solution was adjusted to 55° C. The colorant dispersion liquid (76.9 parts by mass) was added to the solution. Even after the addition, the pigment was observed to neither be precipitated nor aggregated, and remained evenly dispersed in ethyl acetate.

TABLE 1

| | | Ex. 1 | Ex. 2 | Ex. 3 | Ex. 4 | Ex. 5 | Ex. 6 | Ex. 7 | Ex. 8 | Ex. 9 | Comp. Ex. 2 |
|---|---|---|---|---|---|---|---|---|---|---|---|
| Polyester resin A | | 36.7 | 36.7 | 68.5 | 62.9 | 62.9 | 62.9 | 62.9 | 62.9 | 70.0 | 68.5 |
| Crystalline polyester A' | | 2.2 | 2.2 | 4.1 | 4.1 | 4.1 | 4.1 | 4.1 | 4.1 | 4.1 | 4.1 |
| Colorant dispersion | Pigment | 3.1 | 3.1 | 6.1 | 6.1 | 6.1 | 6.1 | 6.1 | 6.1 | 4.6 | 6.1 |
| liquid | Pigment dispersing resin | 4.6 | 4.6 | 9.2 | 9.2 | 9.2 | 9.2 | 9.2 | 9.2 | 9.2 | 9.2 |
| | Ethyl acetate | 30.8 | 30.8 | 61.6 | 61.6 | 61.6 | 61.6 | 61.6 | 61.6 | 62.9 | 61.6 |
| Wax | WAX 1 | 2.8 | 2.8 | | | | | | | | |
| | WAX 2 | | | 5.6 | 5.6 | 11.2 | 11.2 | | | 5.6 | 5.6 |
| | WAX 3 | | | 5.6 | 11.2 | 5.6 | 5.6 | 16.8 | 16.8 | 5.6 | 5.6 |
| Charging control agent | FCA-N | 0.7 | 0.7 | 0.9 | 0.9 | 0.9 | 0.9 | 0.9 | 0.9 | 0.9 | 0.9 |
| Ethyl acetate | | 729.2 | 729.2 | 658.4 | 658.4 | 658.4 | 658.4 | 658.4 | 658.4 | 657.1 | 838.4 |
| Methyl ethyl ketone | | 190 | 190 | 180 | 180 | 180 | | 180 | 180 | 180 | |
| Ethyl propionate | | | | | | | 180 | | | | |
| Solid content | | 50 | 50 | 100 | 100 | 100 | 100 | 100 | 100 | 100 | 100 |
| Total | | 1000 | 1000 | 1000 | 1000 | 1000 | 1000 | 1000 | 1000 | 1000 | 1000 |

The unit is in "part(s) by mass."

TABLE 2

| | | Most frequent diameter | Second peak | Particles in range of 0.79 × Qmax or more but less than 1.15 × Qmax | | | | Particles of 1.15 × Qmax or more | Circu- | Total particles | | | | | Color |
|---|---|---|---|---|---|---|---|---|---|---|---|---|---|---|---|
| | | Qmax [μm] | diameter [μm] | Dv (μm) | Dn (μm) | Dv/Dn | Circu-larity | Circu-larity | larity ratio* | Dv (μm) | Dn (μm) | Dv/Dn | Clean-ability | Transfer-ability | reproduc-ibility |
| Ex. 1 | Toner 1 | 5.51 | 6.99 | 5.60 | 5.53 | 1.01 | 0.967 | 0.953 | 1.015 | 6.31 | 5.70 | 1.11 | A | B | — |
| Ex. 2 | Toner 2 | 5.56 | 7.01 | 5.83 | 5.75 | 1.01 | 0.967 | 0.953 | 1.015 | 6.80 | 5.94 | 1.14 | A | B | — |
| Ex. 3 | Toner 3 | 5.96 | 7.38 | 6.11 | 6.05 | 1.01 | 0.975 | 0.961 | 1.015 | 6.54 | 6.01 | 1.09 | B | A | — |
| Ex. 4 | Toner 4 | 6.11 | 8.20 | 6.30 | 6.23 | 1.01 | 0.968 | 0.954 | 1.015 | 7.21 | 6.47 | 1.11 | A | B | — |
| Ex. 5 | Toner 5 | 5.22 | 6.46 | 5.27 | 5.23 | 1.01 | 0.984 | 0.973 | 1.011 | 6.24 | 5.56 | 1.12 | B | B | — |
| Ex. 6 | Toner 6 | 5.21 | 6.8 | 5.38 | 5.32 | 1.01 | 0.971 | 0.953 | 1.019 | 6.4 | 5.71 | 1.12 | A | B | |
| Ex. 7 | Toner 7 | 6.31 | No peak | 6.5 | 5.94 | 1.09 | 0.986 | 0.969 | 1.018 | 7.84 | 6.71 | 1.17 | A | B | — |
| Ex. 8 | Toner 8 | 8.01 | No peak | 8.31 | 7.6 | 1.09 | 0.987 | 0.969 | 1.019 | 9.87 | 8.4 | 1.18 | A | B | — |
| Ex. 9 | Toner 9 | 5.99 | 7.41 | 6.21 | 6.13 | 1.01 | 0.977 | 0.959 | 1.019 | 6.66 | 6.11 | 1.09 | A | A | A |

TABLE 2-continued

| | | Most frequent diameter | Second peak | Particles in range of 0.79 × Qmax or more but less than 1.15 × Qmax | | | | Particles of 1.15 × Qmax or more | Circu- | Total particles | | | | | Color |
|---|---|---|---|---|---|---|---|---|---|---|---|---|---|---|---|
| | | Qmax [μm] | diameter [μm] | Dv (μm) | Dn (μm) | Dv/Dn | Circu-larity | Circu-larity | larity ratio* | Dv (μm) | Dn (μm) | Dv/Dn | Clean-ability | Transfer-ability | reproduc-ibility |
| Comp. Ex. 1 | Comp. toner 1 | 5.96 | No peak | 5.92 | 5.74 | 1.03 | 0.965 | 0.917 | 1.052 | 6.68 | 5.64 | 1.18 | B | C | — |
| Comp. Ex. 2 | Comp. toner 2 | 5.50 | 6.99 | 5.58 | 5.50 | 1.01 | 0.980 | 0.977 | 1.003 | 6.20 | 5.62 | 1.10 | C | B | — |

Circularity ratio* means a ratio of "the average circularity of particles having a particle diameter range of 0.79 times or more but less than 1.15 times as large as the most frequent diameter" in the number particle diameter distribution in the toner to "the average circularity of particles having a particle diameter of 1.15 times or more as large as the most frequent diameter".

What is claimed is:

1. An electrostatic-image developing toner comprising:

a binder resin;

a colorant; and a release agent, wherein an average circularity of particles having a particle diameter in a range of 0.79 times or more but less than 1.15 times as large as a most frequent diameter in a number particle size distribution of the toner is within a range of 1.010 times or more but less than 1.020 times as high as an average circularity of particles having a particle diameter of 1.15 times or more as large as the most frequent diameter.

2. The toner according to claim 1, wherein the toner has a second peak particle diameter within a range of 1.21 times or more but less than 1.31 times as large as the most frequent diameter in the number particle size distribution of the toner.

3. The toner according to claim 1 or 2, wherein the average circularity of the particles having a particle diameter in a range of 0.79 times or more but less than 1.15 times as large as the most frequent diameter is 0.965 or more but less than 0.985.

4. The toner according to any one of claims 1 to 3, wherein the average circularity of the particles having a particle diameter in a range of 0.79 times or more but less than 1.15 times as large as the most frequent diameter is 0.975 or more but less than 0.985, and wherein the average circularity of the particles having a particle diameter of 1.15 times or more as large as the most frequent diameter is 0.930 or more but less than 0.960.

5. The toner according to any one of claims 1 to 4, wherein a particle size distribution Dv/Dn (volume average particle diameter (μm)/number average particle diameter (μm)) of the particles having a particle diameter in a range of 0.79 times or more but less than 1.15 times as large as the most frequent diameter is $1.00 \leq Dv/Dn < 1.02$.

6. The toner according to any one of claims 1 to 5, wherein the most frequent diameter is 3.0 μm or more but 7.0 μm or less.

7. The toner according to any one of claims 1 to 6, wherein the toner has the particle size distribution Dv/Dn of $1.05 \leq Dv/Dn < 1.15$.

8. The toner according to any one of claims 1 to 7, wherein the toner is produced by a method including discharging a toner composition liquid, in which the binder resin, the colorant, and the release, agent are dissolved or dispersed, to form liquid droplets and solidifying the liquid droplets to form a toner.

* * * * *